US007117946B2

(12) United States Patent
Herr

(10) Patent No.: US 7,117,946 B2
(45) Date of Patent: Oct. 10, 2006

(54) IN-SITU EVAPORATION

(76) Inventor: Wolfgang Herr, Oberste Muhle 5, Immenhausen (DE) 34376

( * ) Notice: Subject to any disclaimer, the term of this patent is extended or adjusted under 35 U.S.C. 154(b) by 176 days.

(21) Appl. No.: 10/485,844

(22) PCT Filed: Jul. 26, 2002

(86) PCT No.: PCT/DE02/02744

§ 371 (c)(1),
(2), (4) Date: Feb. 3, 2004

(87) PCT Pub. No.: WO03/014522

PCT Pub. Date: Feb. 20, 2003

(65) Prior Publication Data

US 2004/0244990 A1 Dec. 9, 2004

(30) Foreign Application Priority Data

Aug. 3, 2001 (DE) ..... 101 37 622
Dec. 4, 2001 (DE) ..... 101 59 311

(51) Int. Cl.
*E21B 43/16* (2006.01)

(52) U.S. Cl. ..... 166/370; 166/369

(58) Field of Classification Search ..... 166/370, 166/369, 296, 297, 117.5, 272.2, 281, 308.1
See application file for complete search history.

(56) References Cited

U.S. PATENT DOCUMENTS 1,812,267 A 6/1931 Lewis
2,624,410 A 1/1953 Nixon
3,608,640 A * 9/1971 Willhite et al. ..... 166/380
4,090,564 A * 5/1978 Cook et al. ..... 166/370
4,155,404 A * 5/1979 Hollingsworth ..... 166/285
4,359,092 A * 11/1982 Jones ..... 166/265
4,498,543 A * 2/1985 Pye et al. ..... 166/376
5,085,276 A 2/1992 Rivas et al.
5,115,866 A 5/1992 Brown et al.
5,188,183 A * 2/1993 Hopmann et al. ..... 166/387
5,318,126 A * 6/1994 Edwards et al. ..... 166/297
5,566,758 A * 10/1996 Forester ..... 166/285
5,924,696 A * 7/1999 Frazier ..... 277/336
6,598,682 B1 * 7/2003 Johnson et al. ..... 166/370

(Continued)

OTHER PUBLICATIONS

International Search Report.

*Primary Examiner*—David Bagnell
*Assistant Examiner*—Daniel P Stephenson
(74) *Attorney, Agent, or Firm*—Ostrolenk, Faber, Gerb & Soffen, LLP

(57) ABSTRACT

The invention relates to methods for the exploitation of desirable geo-productive resources (for example, superheated steam, crude oil, fissuring) from boreholes with an at least partly cemented casing (4), whereby a pressure drop is generated from the rock chamber (5), surrounding the lower borehole chamber (3) to the above, which renders the geo-productive resource exploitable. According to the invention, the resource may be rendered more exploitable, whereby a pressure seal (70, 72, 74, 80) is fitted for a pressure separation between the lower borehole chamber (3) and the flow chamber (1, 14), above the pressure seal (70, 72, 74, 80) within the casing (4), a working pressure (preferably atmospheric pressure) is introduced into at least part of the flow chamber (1, 14) and the working pressure is introduced into the lower borehole chamber (3) and/or into the rock chamber surrounding the above. A vertically-displaceable valve tube (68) is preferably used as lower end section of the production pipe (7).

28 Claims, 14 Drawing Sheets

U.S. PATENT DOCUMENTS 6,810,960 B1 * 11/2004 Pia ..... 166/370
2002/0020535 A1 * 2/2002 Johnson et al. ..... 166/363
2005/0167108 A1 * 8/2005 Chang et al. ..... 166/298

* cited by examiner

IN-SITU EVAPORATION

PRIOR ART

This invention relates to methods and devices for the exploitation of desirable geoproductive resources from boreholes with a casing and a pressure barrier which provides a pressure-tight separation of the external chamber around the casing from the lower borehole chamber, containing the step of generating a pressure drop from the rock chamber surrounding the lower borehole chamber to the lower borehole chamber, which renders the geoproductive resources exploitable.

An example from the prior art of a method such as mentioned in the introduction is disclosed in U.S. Pat. No. 5,085,276 by Rivas. Rivas describes the recovery of oil from low-permeability rock strata by sequential fracturing with steam. It is reported that the heating of formation water and its conversion from a liquid to a gaseous phase by reducing the pressure in the borehole produces a significant increase in the amount of oil recovered from the rock formation to the borehole. In this operation the pressure in the borehole is reduced by pumping.

A disadvantage of this method is that the positive effects in terms of an increase in the recovery rate are limited, because only a relatively slight negative pressure can be produced by the pumps put into the borehole.

A further disadvantage is that a separate pumping capacity is always needed to maintain the pressure drop. If this is missing, the pressure drop diminishes and the recovery rate falls. The borehole chamber then fills with geofluids such as water and oil. If the pressure drop is to be increased again, the borehole chamber must be largely drained again. This is a time-consuming and expensive job.

It is the object of this invention to further improve the method mentioned in the introduction, in order to be able to further increase the already known positive effects, and in order to make the method also available for the exploitation of other geoproductive resources, such as the recovery of superheated steam or other geofluids, such as thermal water, thermal brine, crude oil, natural gas or other raw materials, e.g. methane hydrates.

ADVANTAGES OF THE INVENTION

The subject matter of the invention achieves the above-identified object.

Advantageous enhancements and improvements to the respective subject matter of the invention are found in the dependent claims.

Some definitions of terms that are relevant in connection with the formulation of the claims are given below:

"Geoproductive resources":

In this patent application this generally means:

physical substances from the earth itself, such as gaseous or liquid geofluids, i.e. superheated steam, in particular aqueous superheated steam, thermal water, thermal brine, crude oil, natural gas or other raw materials present at first in solid form, such as methane hydrates, or and in combination with each other also physical and/or chemical processes in the rock strata, such as fracturing to increase permeability or additional cavity formation to increase the porosity of rock in the drainage area of the well, which are directly or indirectly caused by a preferably sudden effect of the low pressure introduced and the consequent difference in pressure from the existing geostatic pressure.

The geofluids can in particular be fluids such as thermal water or thermal brine in the rock chamber, which evaporate at high pressure and at high temperature through the effect of the pressure difference introduced, and which flow upward through the borehole as superheated steam or a multi-phase mixture and undergo further technical processing there, so as to achieve economic success, for example for obtaining electrical energy or process heat from the superheated steam or for the production and further processing of the upward flowing medium itself.

"Lower borehole chamber":

This is intended to mean that free-walled chamber of the borehole which lies below the lower end of the casing and essentially serves as an impaction surface for the fluids, such as steam or crude oil, natural gas, etc., falling into the borehole, to remove them above ground and exploit them there. It can, however, also mean a region of the casing and its environment which, as known in the prior art, has been perforated so as to have sufficient entry area for the fluids. For the principle of the invention is also applicable to such situations.

In its widest aspect according to the invention a method is disclosed for the exploitation of desirable geoproductive resources from boreholes with a casing and a pressure barrier which provides a pressure-tight separation of the external chamber around the casing from the lower borehole chamber, such as the cementing of the casing for example, containing the step of generating a pressure drop from the rock chamber surrounding the lower borehole chamber to the lower borehole chamber, which renders the geoproductive resources exploitable.

The method according to this invention is now characterized in that it contains the following steps:

a) fitting of a pressure seal for a pressure separation between the lower borehole chamber and a flow chamber, above the seal, within the casing, b) introduction of a working pressure at least into parts of the flow chamber, and c) introduction of the working pressure into the lower borehole chamber, with the working pressure being at least so much lower than the pressure previously present there that the resulting difference in pressure is suitable for inducing physical and/or chemical processes in the lower borehole chamber and/or in the rock strata surrounding the latter, which render the desirable geoproductive resources exploitable.

In this operation the introduction of the working pressure is achieved by opening or destroying the pressure seal previously fitted within the casing, after the flow chamber above the seal has been at least for the most part drained.

In a very simple form a pressure seal within the meaning of the invention can be obtained by tubing the well down to the desired final depth with a cemented casing and then providing the lowest region of the borehole with an adequately dimensioned seal which separates the upper flow chamber from the lower borehole chamber.

The water in the well is then removed as far as possible. If the borehole is still full of drilling mud, this should preferably have been replaced beforehand with water.

If the casing itself is used as a flow chamber, the pressure seal can for example be a cementing at the lower end of the casing, and the working pressure can also be introduced after the casing is drained by perforation of the casing.

The general principle of action of this invention is explained as follows:

This invention is based on the possibility of connecting very different pressure ranges by means of a sufficiently pressure- and temperature-resistant pipeline, via conventionally drilled wells, and in particular deep wells, by opening the aforesaid pressure seal in a controlled way. The pressure seal is positioned at a predetermined location in the borehole chamber, depending on the magnitude of the pressure drop to be produced and the technically exploitable effects intended therewith. If the pressure drop is to be large, the pressure seal is positioned as far down as possible in the borehole, and indeed within the casing, the outer chamber of which is for its part adequately sealed by a cementing, for example.

A relatively low working pressure, in particular atmospheric pressure, is thus introduced into the lower borehole chamber by opening the pressure seal, so that there is an abrupt equalization of pressure between the relatively high pressure of the deep-lying rock strata and the atmospheric pressure.

Since the geostatic pressure increases by about 100 bar per 1000 meters of depth (1 bar corresponds to approximately $1.013*10^5$ Pa), sudden pressure drops of enormous magnitude arise, depending on the depth of the well, for example 400 bar at the pressure seal at the time of opening. The physical processes which commence immediately after the seal is opened seek to produce a pressure equilibrium. Since in certain cases these processes take place in the high pressure region at a depth of several kilometers, where there is primarily a very high pressure, depending on the permeability of the rock the sudden reduction of pressure continues in a wavelike manner further or less far into the rock chamber, depending on how permeable the rock is. If the pressure drop is large enough, as a result of the sudden opening there is even artificially induced fissuring, which it was hitherto only possible to produce in reverse in the prior art (fracturing), namely by introducing overpressure. In so doing, up to about 1000 bar of pressure is produced in the prior art.

Because of the low pressure that suddenly arises, sufficiently hot formation water turns abruptly into steam and can leave the formation at high speed, especially in rock formations which are significantly more permeable to gas than to liquid, and be transported upward through the lower borehole chamber and the adjoining flow chamber. There the superheated steam can then be exploited economically, in particular for the generation of electricity or for the generation of process heat and/or for district heating.

In formations in which a gaseous phase is already present, the latter can be recovered through the additional fissuring with a greater recovery rate. In formations in which solid substances that can be dissociated relatively easily are present, dissociation can begin as a result of the sudden reduction of pressure and a desired substance can be released. This is for example the case with methane hydrates, where methane is released and water is left in the form of either ice or liquid water.

As a result of the continuous escape of the gaseous phase from the rock chamber, a pressure equilibrium is not restored until after a certain time, which is often quite long. This is the case if in the deep rock chamber the path for the gases released by the removal of pressure to the borehole is too far and the decrease in pressure thus becomes too big, i.e. no further pressure-dependent evaporation takes place. For economic use of the method according to the invention for the recovery of superheated steam, the period should be sufficiently long, so that an appropriate amount of superheated steam can be continuously recovered.

In the special case of application of the present invention for obtaining an increased flow rate of crude oil from low-permeability source rocks, the oil entering the lower borehole chamber can be pumped off, in order to maintain the pressure drop for as long as possible.

The geoproductive resources described herein are therefore rendered exploitable in an improved way according to the present invention. The exploitation of these geoproductive resources comprises in particular the following four areas of application:

1. The production of steam in deep-lying, hot rock units, to which reference is also made as "in-situ evaporation". In this process aqueous fluids such as occur in nature, mixed with other substances, salts in particular, are converted by the very rapid and pronounced reduction in pressure from their liquid phase to a gaseous phase and carried upward through the lower borehole chamber and the flow chamber situated above it.
2. The production of cracks in the rock (fracturing) by the already mentioned pressure drop, which can sometimes be sudden, from the rock chamber in the direction of the borehole chamber.
3. Improving the flow behavior of crude oil and increasing crude oil production in low-permeability oil-bearing rocks, and
4. Releasing methane from methane hydrates in marine deposits and in the permafrost zone.

The first three of the aforesaid areas of application are all especially preferred and applicable with great effect in deep borehole regions. The core of the invention therefore lies in the fact that the reduction in pressure which is brought about can in fact be so great that all four of the aforesaid areas of application can come into play and profit from the invention. Depending on the area of application, different advantages over the methods existing in the prior art are obtained.

The essential prerequisites for use of the inventive method and the advantages are described below specifically for the respective areas of application:

Ad 1. Steam production:

In order to be successfully used, for the application of the method according to the invention special rock physics conditions well known to the person skilled in the art, which especially relate to the pore volume, the rock temperature and the flow behavior of liquids and gases in the rock in question, should be fulfilled: depending on the existing bore depth, in particular the reservoir temperature should be sufficiently high, and the rocks should exhibit a sufficiently high flow resistance for the liquid phase and a relatively low flow resistance for the gaseous phase. In particular, the size ratio of the interface between the solid and liquid phase (heat exchange interface) in the rock chamber to the volume of liquid available in each case should be such that rapid evaporation is guaranteed. If there is increased entry of liquid phase into the lower borehole chamber after the pressure seal is opened, however, an attempt can be made to maintain the big pressure drop existing according to the invention for as long as possible by simultaneously pumping off the liquid phase. The method is applicable with special preference in the case of high-temperature rock regions with low fluid production, which are therefore of no economic interest for the methods of geothermal energy production that are known in the prior art. Economically effective exploitation of these is possible only by application of the invention.

As a result of the present invention downhole production and recovery of water vapor is thus possible for the first time even from areas in which there are no natural steam reservoirs. Particularly suitable are rock strata with a relatively high temperature, i.e. volcanically active areas for example, but also nonvolcanic areas which can be exploited via wells of suitable depth.

Ad 2. Fracturing methods:

Relative to the fracturing methods known in the prior art, which are all based on the same overriding principle of injection of fluids, gases and gels with proppants at very high pressures, with forces which are directed from the borehole into the rock complex and destroy the mechanical strength of the rock with fracturing, the fracturing method of the present invention is differentiated by the fact that operation is at extremely low pressure. A pressure drop in the reverse direction is therefore achieved.

The document of the prior art which comes closest to this aspect of the present invention is U.S. Pat. No. 5,085,276, the disclosure and disadvantages of which relative to the present invention were discussed above.

Ad 3. Improving the flow behavior of crude oil:

Methods known in the prior art use the above-mentioned fracturing method to achieve improved fracturing in the target horizons, so as to increase the permeability of the rock and thus improve the flow behavior of crude oil. The same thing applies, mutatis mutandis, to the recovery of natural gas.

According to the present invention, fracturing can be achieved in the rock strata of the target horizon by the sometimes abrupt introduction of the working pressure, thus increasing the permeability and consequently in general also the recovery rate. In so doing, advantage can be taken of the inventive principle in two respects: firstly on the basis of the fracturing, secondly on the basis of the pressure drop applied in the direction of the borehole, which supports the natural direction of recovery for the geofluid (e.g. crude oil). This constitutes a decisive advantage over the prior art, in which the pressure drop used in fracturing is applied in precisely the opposite and thus "wrong" direction.

In particular, in its basic form the method according to the invention can be adapted to the improved recovery of crude oil or natural gas by a procedure whereby the additional fluid entering the lower borehole chamber as a result of the fracturing produced is pumped uphole through a separate pumping line, thus keeping the rise height of the oil column in the borehole small, so that the effect of the low atmospheric pressure can be maintained even for a longer time. In addition, in sufficiently hot oil-bearing rocks, a sufficiently high removal of pressure can convert any liquid water present in the crude oil into steam and improve the flow behavior of the crude oil and the degree of oil removal from the rock.

Ad 4. Release of methane from methane hydrates:

By the introduction, according to the invention, of atmospheric pressure into deeper strata it is in principle also possible to obtain methane from the so-called methane hydrates if they are present in such strata. The methane hydrates occur as crystalline, ice-like accumulations in marine deposits and in the permafrost zone of the arctic regions. They are only stable under particular pressure and temperature conditions, e.g. at 10 bar pressure only when the temperature is less than −12 degrees Celsius (261 Kelvin) or at 1000 bar pressure up to about 30 degrees Celsius (303 Kelvin). The methods known in the prior art for the recovery of methane from methane hydrates are based on the principle of increasing the temperature of the methane hydrate reservoir, in order to overcome the stability limit for the methane hydrate, and splitting off the methane in the form of gas from the methane hydrate. This is an uneconomic method, as a relatively large amount of thermal energy has to be brought to the reservoir. This is relatively energy-intensive and expensive, especially in view of the relatively low energy density of methane hydrate. An alternative use is in the physical recovery of methane hydrate from the sea bed, for example, but this is also expensive and often associated with environmental damage.

Here the present invention adopts a completely new approach, by changing the pressure rather than the temperature, so as to go beyond the stability range for methane hydrate and cause dissociation.

In view of the low energy density of methane hydrate, of about 18% relative to liquefied natural gas, especially stringent economic criteria have to be applied here in the application of economic recovery methods. The present invention can make a valuable contribution here, because it greatly reduces the costs when the phase transformation from methane hydrate to methane and water ice takes place through the removal of pressure according to the invention. From the ecological point of view, too, this method offers considerable advantages over the recovery of methane hydrate from the sea bed.

The idea of the present invention that is common to all four of the aforesaid areas of application therefore takes advantage of the physical fact that certain states of aggregation and substance modifications are stable only under particular pressure-temperature ranges. According to the present invention this stability is broken up and in this way the associated geoproductive resource is released, as has been described above. In the special and preferred case of geothermal application the rapid reduction of the pressure in the deep and hot rock chamber, by means of the introduction and activation of atmospheric pressure as a low pressure source, causes the hot thermal waters or thermal brine present there under high pressure to evaporate without any need to supply energy. The evaporation process can therefore in a certain respect be described as "endothermic" or autonomous, since it often takes place without any supply of external energy and obtains its energy from the conditions prevailing in the deep and hot rock chamber.

This evaporation process lasts as long as the water vapor arising can escape through the pipeline present.

The reduction of pressure for the recovery of methane from methane hydrates releases methane and water, the latter being either in liquid form or in solid form, as ice, depending on temperature. This process can also be described as endothermic, since once it is started it continues spontaneously, without needing any further supply of energy from outside. In order to make recovery economic, it is advisable if possible to support a recovery process by ensuring that the pressure drop is maintained throughout the entire recovery process. This can for example be done by switching on additional pumps to draw off the geofluid to be recovered. With regard to the improved recovery of crude oil, the method according to the invention can also be used advantageously for the recovery of oil from low-permeability oil-bearing rocks.

Furthermore, under suitable geological conditions it is possible to produce fractures in the low-permeability rock which make subsequent hydrogeothermal utilization of the thermal waters or thermal brine possible, even in areas which have previously been exploited by means of in-situ evaporation according to the invention.

PREFERRED FEATURES OF THE INVENTION

In a further preferred development of the method the pressure seal can be suddenly opened, resulting in an especially abrupt pressure change which can cause especially pronounced fracturing with an especially big increase in permeability.

The application of the pressure seal is preferably combined with the introduction of the production pipe into the completely tubed well: thereafter the inventive method contains the following steps:

a) preparatory fitting of at least one external pressure seal for pressure-tight separation of the external chamber around a production pipe, preferably to the casing, from the lower borehole chamber,
b) introduction of the production pipe into the borehole chamber, with this being sealed in its lower area with a pressure-tight internal seal serving as a pressure seal, with water or drilling mud being forced out upward through the annular space,
c) activation of the external pressure seal, with the annular space around the production pipe optionally being drained,
d) opening of the internal seal of the production pipe, and
e) use of the interior of the production pipe as a flow chamber in the sense referred to above.

The external pressure seal is an annular packer made from a material that is resistant to high pressure and high temperature. For this purpose it is possible to use teflon-coated annular packers or metal packers which are of sufficiently soft and flexible construction to form an adequate pressure seal when—as is usual in the prior art—they are filled for activation purposes under pressure with a filling material such as liquid cement. In this operation the production pipe, with one or more annular packers at its lower end, can advantageously also be introduced into the casing, in order to combine the aforesaid steps a) and b). In this operation it should not be activated, i.e. be in an uninflated state, so that the water or any drilling mud present can be expelled upward from the tubed borehole chamber when the production pipe with the lower end closed is introduced into the borehole chamber. The aforesaid internal seal should have a sufficient pressure and temperature resistance to withstand the physical conditions at the target depth. It can preferably contain ceramic constituents. A ceramic seal has furthermore the advantage that it can be destroyed with relative certainty by a blow from above, since ceramic, as is known, cracks easily. The seal can advantageously be designed in such a way that it has a downward-convex shape, seals the entire internal cross-section of the production pipe and is if necessary additionally provided with a protective body which can prevent unintended destruction of the internal seal by mechanical damage when the production pipe is put into the casing.

Alternatively or in combination with the above-mentioned annular packer(s) as an external pressure seal between the production pipe and the casing, the end section of the production pipe can also preferably be provided with a threaded member which fits a corresponding threaded member which in the end section of the casing is connected with the latter in a pressure-tight way, e.g. welded. The production pipe can then be screwed to the casing at the target depth, thus reliably sealing the annular space. This has furthermore the advantage that the seal can also be broken again if for some reason this should become necessary. The slide faces of the threads advantageously have a suitable slide coating, e.g. of teflon, which reduces the torque required for turning and favorably also offers additional sealing properties. Alternatively the shape of both the end sections of the casing and the production pipe might also be designed in such a way, by preselected forming, as to produce a form-fit connection which through corresponding pressure also provides the necessary leakproof seal. Here, too, an additional coating of the production pipe, in particular, with a soft, temperature-resistant material, molybdenum sulfide for example, can be provided in order to guarantee additional sealing properties.

In a further preferred embodiment the above-mentioned pressure seal is destroyed by dropping a falling body with a predetermined weight and predetermined shape from the above-ground end of the well.

In a further preferred embodiment the lower borehole chamber, the wall area of which serves as an inlet surface for the geofluids to be recovered, is at least partially filled with a gravel pack which has very high permeability and otherwise displaces any water present there. This has the advantage that the incoming vapor phase does not entrain any water, or entrains only a relatively small amount of water, thus preventing premature condensate formation on the edges of the production pipe or casing.

In a further preferred embodiment of the inventive method the annular space around the production pipe is made with the lowest possible thermal conductivity, so as to allow as little as possible of the heat content of the geofluid which is to be recovered, especially in the case of superheated steam, to escape to the outside through the pipe wall. This can for example be done by removing any water or drilling mud present there and replacing it with air or inert gas, e.g. nitrogen, as gases only have low thermal conductivity at normal pressure.

The method according to the invention can also be used for the rapid evaporation of water from rocks at relatively low temperature, when the thermal insulation of the production pipe and/or the length thereof is such that steam of sufficient temperature arrives at the upper end of the borehole. It can also be used with methods known in the prior art, such as the hot dry rock method for example, or in the evaporation of fresh water previously injected artificially into hot rock, or in the improved recovery of crude oil in combination with the injection of hot water or superheated steam or in natural gas, such as nitrogen or carbon dioxide, or of polymers and surfactants. The method according to the invention is in principle also suitable for increasing porosity and permeability for the purpose of in-situ leaching of metal ore deposits.

In a further, especially preferred way, internal seals which can be reversibly actuated are also provided according to the invention. These have the advantage, especially in the recovery of superheated steam, that a well can easily be tested for economic viability for superheated steam production, with it being possible to stop the steam flow again after the completion of a test, with hardly any water accumulating in the borehole when the seal is situated a very long way down the borehole. In addition, such reversible seals can also be used to control the flow rate of the steam. A seal which can be reclosed and opened in a relatively simple and reliable way is for example also used at times when servicing jobs have to be done on the production pipe, in order to remove accretions for example (so-called reaming). In such a case the production pipe 7 does not need to be laboriously removed beforehand and then refitted after the cleaning work has been carried out. This saves money and time.

DRAWINGS

Embodiments of the invention are shown in the drawings and explained in more detail in the subsequent description.

DESCRIPTION OF THE EMBODIMENTS

Identical reference signs in the figures denote components which are identical or have identical functions.

Figure 1:
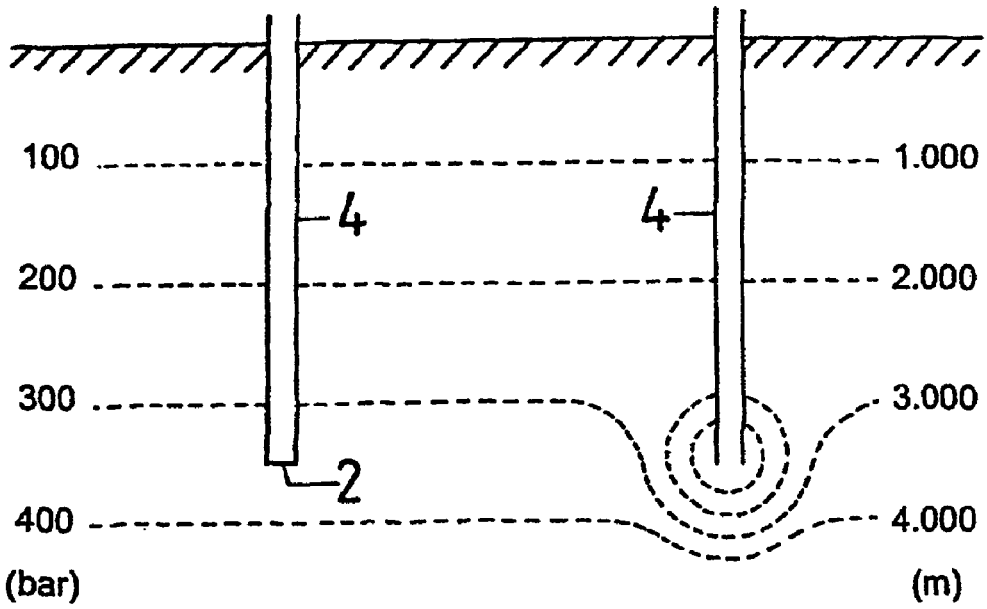
FIG. 1 is a schematic sketch in simplified form to illustrate the basic concept of the present invention.
Figure 2:
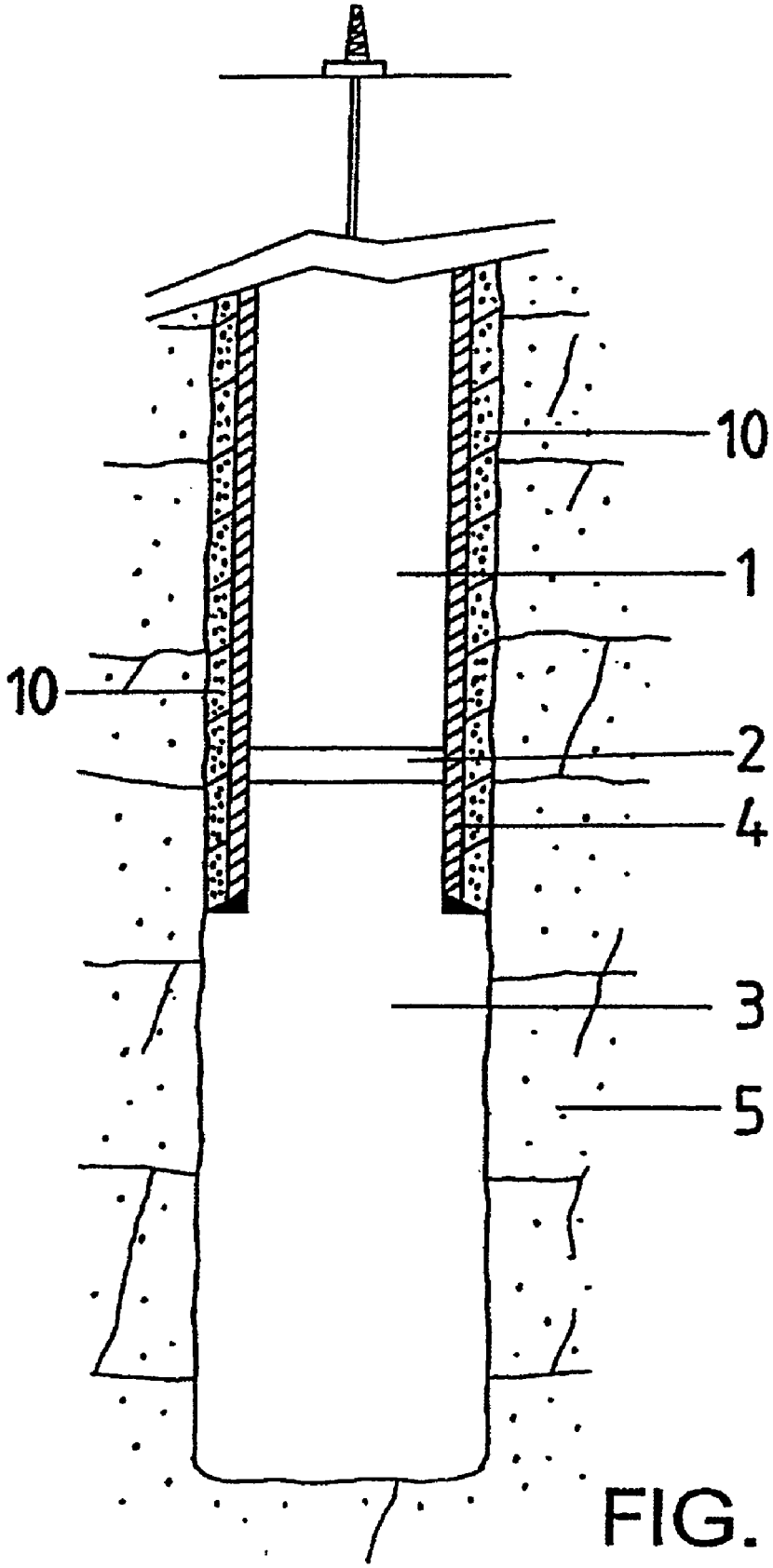
FIG. 2, 2A is an outline drawing which shows a pressure seal closing the casing internally.

In its left-hand part FIG. 1 shows a borehole which is provided with a casing, with the top end being open and the bottom end closed. Details of this are shown in FIG. 2. In the right-hand part of FIG. 1 the borehole is shown after the opening of the seal at the bottom end of the borehole. In the left-hand margin there is a pressure scale, showing the hydrostatic pressure in bar, and in the right-hand margin there is a corresponding depth scale in meters. These scales should only be interpreted schematically, the key point for the purposes of the present invention being simply that in the depths of the borehole the pressure in the rock chamber is very high in comparison to atmospheric pressure. The precise variation in pressure as a function of depth does not matter, therefore.

The right-hand part of FIG. 1 shows how the pressure field changes after the pressure seal is opened. Atmospheric pressure is fed through the opening in the seal via the pipe represented in FIG. 1 into the deep-lying, hot rock chamber.

If the method according to the invention is to be used for the production of superheated steam from these rock strata, the hot rocks exhibit a preferably low permeability. Their pore space is filled with hot water or brine under pressure. If, as a result of the introduction of atmospheric pressure into the lower borehole chamber, according to the invention, the hot fluids are now subjected to low pressure, which is so low that it lies below the condensation pressure for the steam, then the fluids evaporate in situ, i.e. in the pore space. This is why the method according to the invention in this instance is called "in-situ evaporation" (ISE).

Without going into the details of the opening of the pressure seal itself, which is done below, the ISE process starts in the borehole chamber in the immediate vicinity of the opened seal and continues into the neighboring rock until the pressure of the steam on the evaporation front reaches the condensation pressure, which once again is a function of the temperatures prevailing in the rock. This process is represented in a snapshot in FIG. 1, where the dashed lines represent isobars at 400 bar, 300 bar, 200 bar and 100 bar, respectively. The low pressure which is made available by the atmospheric pressure introduced passes into the rock strata surrounding the borehole.

The vapor pressure which dynamically varies there as a result does not build up to the extent that it reaches the condensation pressure again, as long as the temperature of the system is sufficiently high and a pressure-temperature equilibrium is not established. On the contrary the steam arising flows to the earth surface through the borehole and the flow chamber which is formed by it. The pressure/temperature imbalance is thus in essence maintained, a certain steady-state condition is established, and the superheated steam emerging at the earth surface can be used economically by methods known in the prior art, for the generation of electricity for example.

The decrease in pressure caused by the opening of the pipe causes the liquid phase inside the rock chamber to flow in the direction of the borehole, because there is an extreme pressure drop in the direction of the borehole. If rock formations which are particularly well suited to steam production are present, the migration of the liquid phase takes place only slowly as a result of the low rock permeability. The evaporation front, on the other hand, advances relatively quickly into the rock chamber, since the steam produced flows very much more quickly in the direction of the borehole, even through low-permeability rock, than a liquid phase would be able to do. The evaporation cools down the rock on the steam side and leads to additional fissures, since marked differences in cooling arise in the rock in a very small space. As a result additional porosity, which has hitherto been sealed, is subjected to evaporation. The total cooling leads to a slight contraction of the rock and thus creates additional permeability on the steam side. The precipitation of previously dissolved solids, as an exothermic process, has in aggregate a favorable effect on the energy balance. The energy gain depends on the salinity of the solutions in each case. Details of this are explained below with reference to FIGS. 7 and 8.

Further details of the previously described basic concept of the present invention are shown in FIG. 2:

FIG. 2, like some other representations, shows a drilling rig, represented symbolically and on a reduced scale, in the upper section, and in the lower section certain details, considerably enlarged in comparison thereto, to which reference is made.

The upper borehole section is represented with reference sign 1. It has a casing 4, of a diameter of 7 inches for example. The lower final section of the casing has a cementing shoe, and a cementing 10, cylindrically surrounding the casing 4, seals off the lower borehole chamber 3 from the remaining gap space surrounding the casing. The cementing 10 can be effected using techniques known in the prior art and can be favorably combined, even in especially high pressure ranges, with an annular packer such as is also known in the prior art for the aforesaid high pressure and temperature ranges, see for example: Bulletin d'Hydrogéologie No. 17, 1999, Centre d'Hydrogéeologie, Université de Neuchâtel, pages 159 to 163. The cementing 10 forms the pressure barrier to which reference is made in the specification and claims. Up to this point the setup is known in the prior art.

According to the invention a pressure seal 2 is now first of all fitted within the casing for a pressure separation between the lower borehole chamber 3 and the cavity leading further up, the flow chamber 1 within the casing 4.

The pressure seal 2 is sketched only schematically. It separates the space in the interior of the casing, which forms the flow chamber in an upward direction, from the lower borehole chamber 3.

Figure 4:
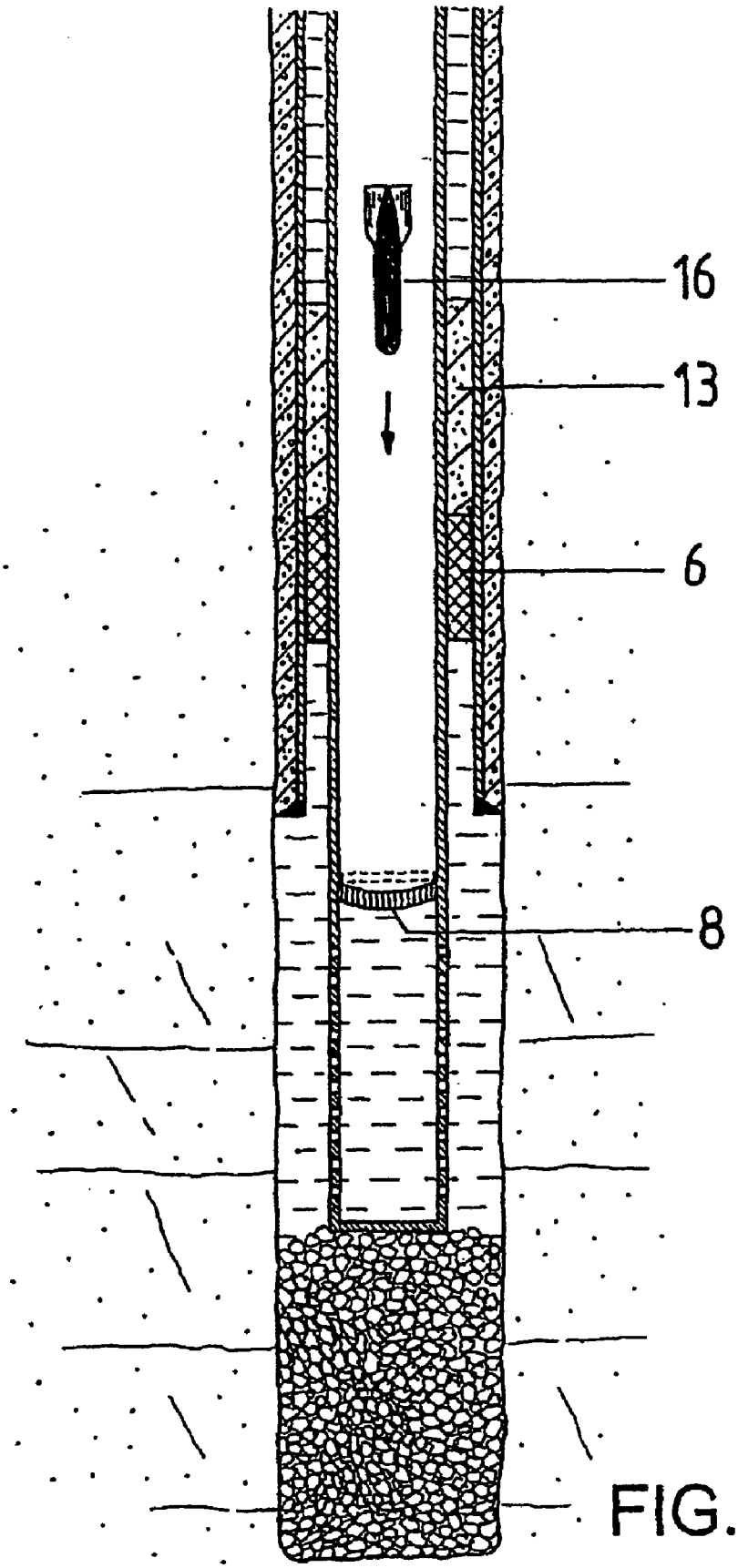
FIG. 4 is an outline drawing with a gravel pack in the lower borehole chamber, suitable for the embodiment in FIG. 3, with a drop weight being represented just before the destruction of the internal pressure seal.

There are a plurality of possibilities for constructive elaboration of the pressure seal 2. Reference is made to some of them herein. A simple variant is executed as follows:

A gravel pack 12 is inserted into the lower borehole chamber, as explicitly represented in FIG. 4. The gravel pack 12 should preferably have very high permeability, in order that the superheated steam to be produced can subsequently penetrate this pack easily. For the sake of greater clarity the gravel pack 12 is not shown in FIG. 2. It is used, however, for fitting the pressure seal 2, which can for example be constructed as a cementing layer of a certain predetermined thickness. This cementing layer should be only of such thickness that it can if necessary be destroyed again at a later time with simple means, preferably without drilling, in order to start off the evaporation. At a pressure of about 300 bar for example in the lower borehole chamber this cementing layer is fitted in the hot fluid present there, e.g. thermal water. The thickness of the cementing layer must be adapted to the prevailing pressure and temperature conditions.

When the pressure barrier 2 is able to withstand pressure differences arising between its upper side and lower side, it is possible to begin draining the tubed upper borehole section 1 above it. This can for example be done in the way described below in connection with FIG. 9.

When this space 1 has been sufficiently drained, and when all necessary measures have been taken above ground for the technically useful processing of any superheated steam emerging from the casing, e.g. for electricity generation in accordance with the prior art, then the seal 2 can be destroyed in a controlled way and thus opened as the initiator for the production of the steam. The destruction can for example be effected by means of a shot with a precisely predetermined explosive power. When the pressure seal 2 has been destroyed, according to the invention atmospheric pressure passes through the casing into the lower borehole chamber 3, which is at high pressure. The pressure decreases there abruptly, and the effects described above occur, so that superheated steam enters the walls of the lower borehole chamber 3 and is conveyed upward through the flow chamber 1. The evaporation of the aqueous phase in the surrounding rock systems 5 at high temperature is achieved through the very sudden creation of the extremely marked difference in pressure between the atmospheric pressure at the earth surface and the depth area 3 of the borehole, which is restricted in volume, at high pressure and sealed off by a pressure-tight seal from the annular space.

This sudden reduction in pressure causes immediate boiling and evaporation of the aqueous fluids which are present in the lower borehole chamber. This boiling and evaporation then continues into the rock chamber 5, and the reader can be referred to the above-mentioned description of FIG. 1.

Figure 3:
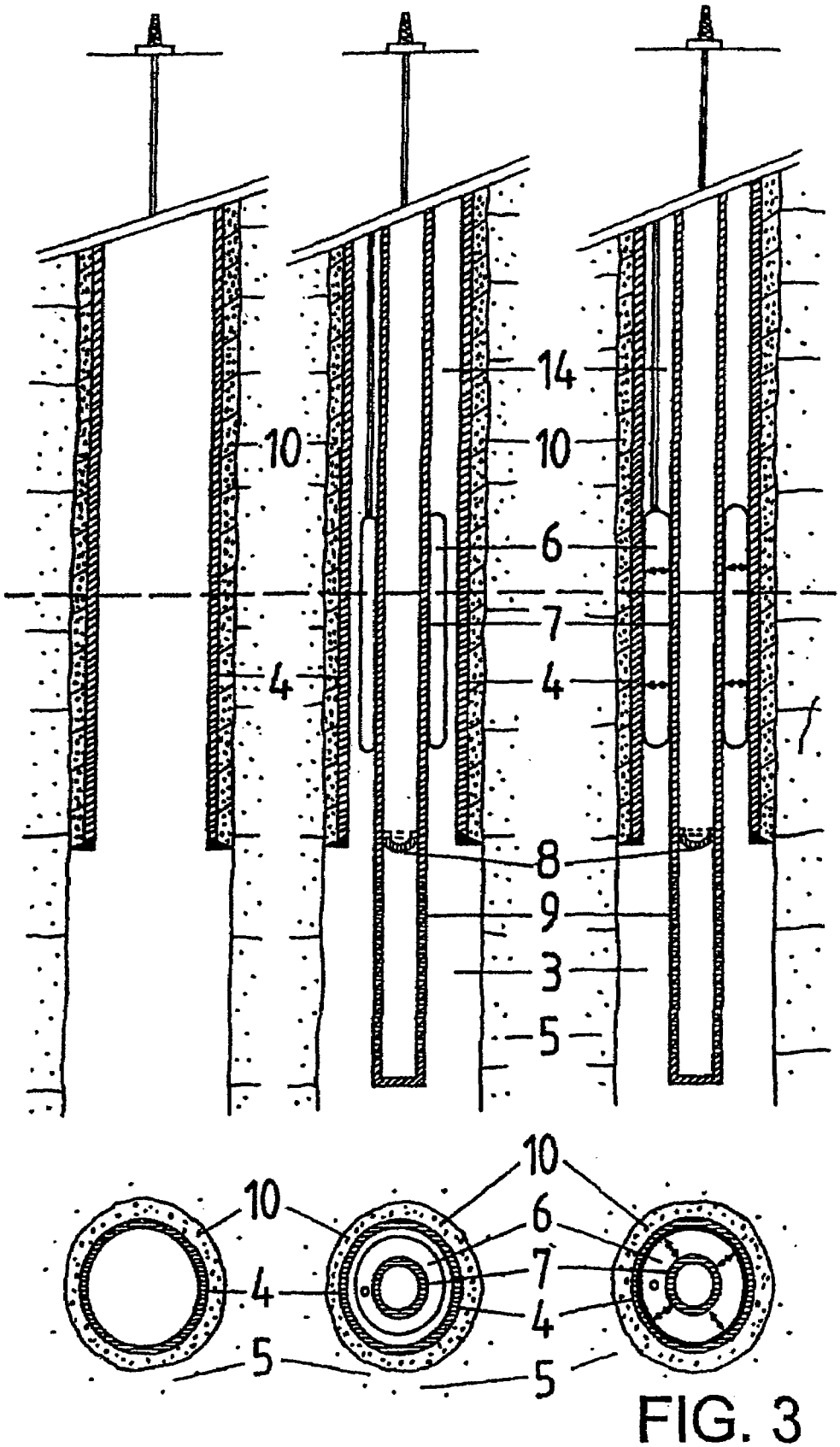
FIG. 3 is an outline drawing which shows a further embodiment of the present invention, with different states during the method according to the invention being shown from left to right, with a production pipe situated in the interior of the casing being used as the flow chamber.

With reference to FIG. 3 a further embodiment of a method according to the invention, which uses a suitable production pipe 7 for the production of superheated steam, is described below. The main part of the figure represents a schematized longitudinal-section representation through relevant regions of the borehole, whereas the lower part represents schematized cross-sectional representations, for each of the corresponding upper three individual images, along the horizontal dashed line in the main part.

As in FIG. 2, the pressure-tight cemented casing, below which the untubed lower borehole chamber 3 begins, is illustrated to the extreme left. This is later to serve as an entry surface or entry space, via its walls, for the superheated steam to be recovered. An annular cementing 10 again represents a pressure barrier between the outer space around the casing 4 and the lower borehole chamber 3.

According to this embodiment according to the invention, a production pipe 7, which on its lower end section has a not yet expanded annular packer 6, is now inserted, see figures in the middle. The production pipe 7 contains an internal seal 8 and a protective body 9 provided for this. If a 7-inch casing is used, a 4½-inch production pipe 7 can for example be used, as usual. The internal seal 8 has a downward-convex shape and contains ceramic components, so that it is resistant to high temperature and resistant to high pressure against a big difference in pressure between its convex (high pressure adjacent) and its concave face.

In order that it can subsequently be easily destroyed, it is designed with a relatively low resistance to pressure. The annular packer 6 is also designed to withstand high pressure and high temperature and can contain teflon layers for example or be made from a suitable metal construction, so as to have the required temperature stability and strength. Here also the reader is referred to the above-mentioned publication for prior-art packers. The packers are constructed in such a way that they still provide an adequate seal even after a certain degree of mechanical stress and thermal stress over a prolonged period. If necessary, several packers are placed in series.

The protective body 9 is for example designed in such a way as to be screwable onto the production pipe and tubular, is closed at its lower front end and has sufficiently large hole perforations via its cylinder walls to form a sufficiently large entry area for the superheated steam to be produced, after the sealing disk 8 is destroyed. The protective body 9 has the function of protecting the internal seal 8 from unintended destruction during the insertion of the production pipe into the casing 4.

The right-hand part of the illustrations in FIG. 3 shows the packers 6 in the expanded state, so that the lower borehole chamber 3 is separated by a pressure-tight seal from the annular space 14 further up.

Here, too, a gravel pack 12 can optionally be provided, in order to have as little water as possible in the lower borehole chamber 3. The gravel pack 12 expels the water present in the lower, untubed borehole chamber and thus has the effect that when evaporation starts less water is entrained, so that there is less dissipation of heat from the rising phase mixture via the pipe wall to the outside. This helps to keep the steam hotter and the energy yield higher. Moreover, the large surface of the gravel pack provides an additional heat exchange surface for heating up the liquid phase in the lower borehole chamber.

The internal seal 8 is preferably designed as a ceramic disk with the aforesaid downward-convex shape, so as to provide good static diversion of the pressure forces on the pipe wall of the production pipe 7, and so that it can at the same time be destroyed relatively easily from the inside of the production pipe. The ceramic should preferably be such as to break into many small individual parts when for example, as indicated in FIG. 4, the disk is to be deliberately destroyed by a body falling from above.

The situation represented in FIG. 4 follows on from that in FIG. 3. The interior of the production pipe 7 is free of liquid and is preferably only filled with air. The production pipe has an open end with a connection to the technical facilities present above ground for the exploitation of the superheated steam. In particular, several throttle valves can be provided, in order to be able to influence the amount of steam produced per unit of time. The annular space between the production pipe 7 and casing 4 is first of all filled with water, but is preferably drained after activation of the annular packer 6 and, if applicable, after fitting of an additional annular space cementing 13, in order to reduce the thermal conduction between the production pipe and the casing. The steam thus stays hotter.

Part of the lower borehole chamber 3 contains the above-mentioned gravel pack 12 and part is filled with water. A pressure of 300 bar and a temperature of 300 degrees Celsius, 573 Kelvin, for example, prevail in the borehole chamber.

With further reference to FIG. 4, the deliberate opening of the internal seal 8 from FIG. 3 is described. This can in principle also be used for opening the seal 2 in FIG. 2.

The seal 8 can be opened in a controlled way when all the technical preparations for the production and further treatment of the superheated steam to be recovered have been completed. For a ceramic seal as previously described, for example, this can be done by dropping a drop weight with a predetermined shape, hardness and weight, which because of the relatively big drop height has a sufficiently high kinetic energy for the impact on the ceramic disk 8 to be big enough to destroy it. In order that the destruction can be controlled, complete and optimized from the point of view of production, the disk should leave the pipe cross-section as completely as possible, without leaving any interfering remnants behind. Suitable predetermined fracture lines can be present in the ceramic disk for this purpose. The ceramic disk 8 is destroyed in a controlled way by the impact of the falling body 16 on its concave-shaped internal face. This introduces the aforesaid low working pressure into the lower borehole chamber, which then triggers off the intended physical and chemical processes that are necessary for superheated steam production. For this the reader can be referred to the statements made above.

Figure 2A:
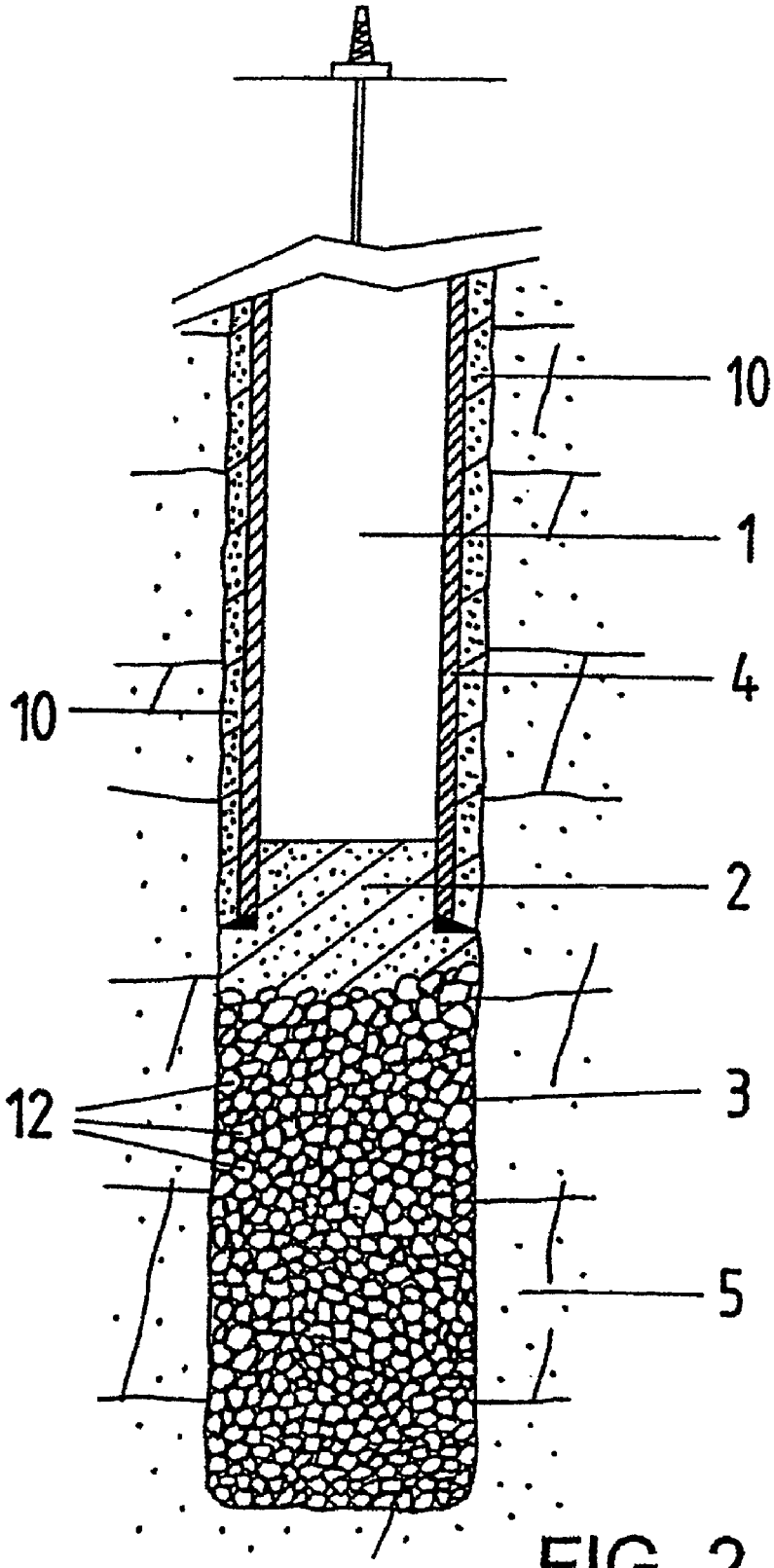

The falling body 16 can have stabilization wings which help it to fall quickly and in a straight line. It can have a suitable weight, depending on the construction of the ceramic disk. If the weight is to be particularly great, it can be made suitably elongated, with a small cross-section, so that the subsequent production process is not impeded by the fact that it constitutes an obstacle which reduces the cross-section too much. For these purposes it can also have a built-in explosive charge, which after destruction of the ceramic disk breaks it up in a controlled way into small parts. An alloy or a pure substance of a preferably heavy metal can for example be used as the material. A sandwich construction, consisting of an especially heavy body and an especially hard impact surface, can preferably be used. Since it is only a few meters thick, the cementing 2 mentioned above with reference to FIG. 2A might also be dry-drilled or destroyed with a pneumatic hammer tool.

Figure 5:
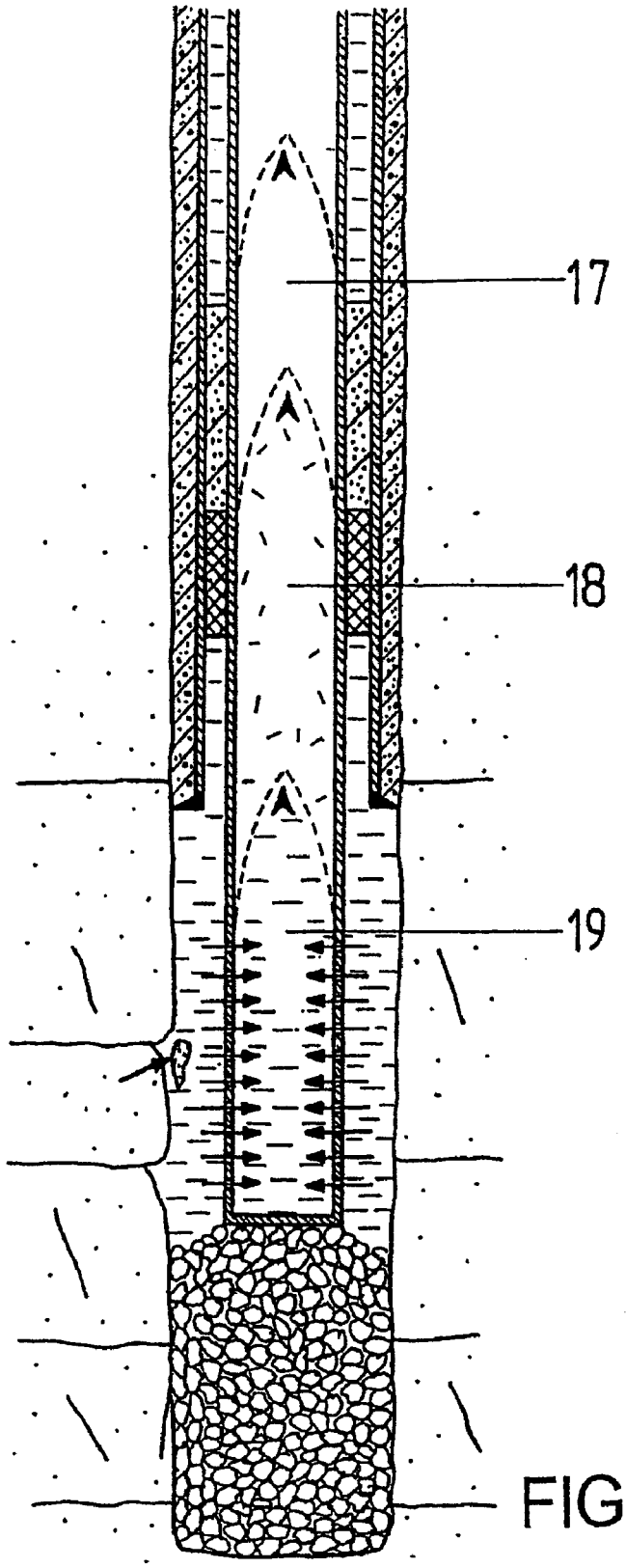
FIG. 5 is an outline drawing following on from FIG. 4, which illustrates the effect of suddenly opening the seal in the immediate vicinity of the well.

The effect of the destruction of the seal 8 is represented schematically in FIG. 5 for the interior of the production pipe and the directly affected borehole chamber 3 at the point in time immediately after destruction of the seal: the very hot water at high pressure in the lower borehole chamber 3 is confronted by the low atmospheric pressure when the seal is opened. As a result it evaporates immediately. It abruptly initiates an upward flow, with any unevaporated water or solid parts (see arrow) being entrained upward by the rapidly flowing water vapor. This gives rise to a multi-phase mixture, in which the water vapor component advances upward fastest. Different regions are shown as examples in FIG. 5, namely a water vapor region 17, a mixed-phase region consisting of water and water vapor 18, and a liquid-phase region consisting solely of water 19. The water present in the lower borehole chamber in region 19 has been evaporated or entrained upward by the vapor stream at a faster or less fast rate, depending on the amount of water present in the lower borehole chamber as a liquid phase before the opening of the seal 8, and depending on the amount of the afterflow fluid, whether as vapor or in liquid form.

Figure 6:
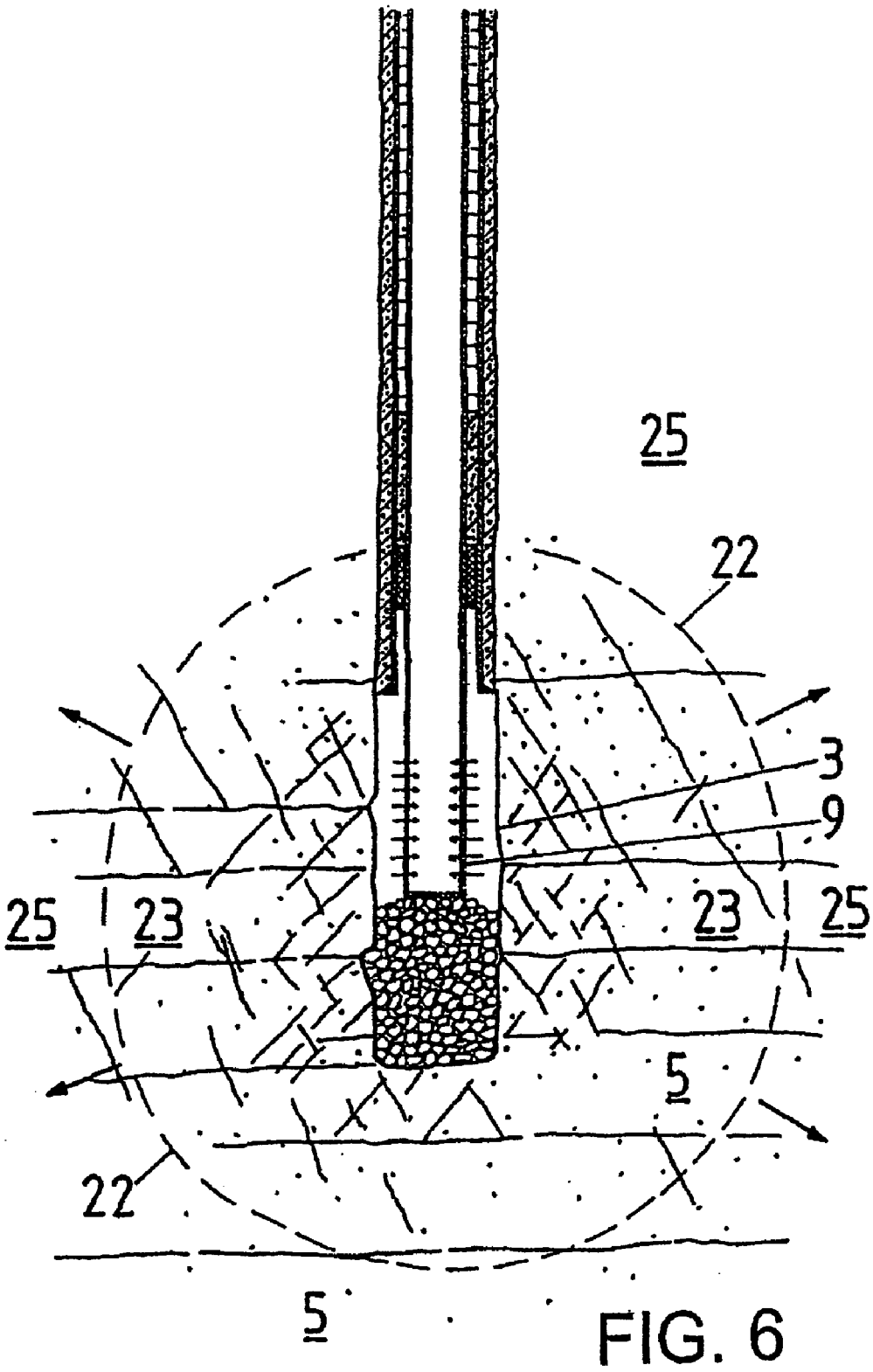
FIG. 6 illustrates the effect continued from FIG. 5 in the wider vicinity of the lower borehole chamber.

Then, probably after a few seconds in most cases, evaporation starts in the rock chamber 5, which surrounds the lower borehole chamber. This is illustrated in FIG. 6.

The lower borehole chamber 3 is now completely filled with steam, i.e. the mixed-phase region 18 and liquid-phase region 19 no longer exist. The low pressure thus continues into the rock via the pervious parts present in the surrounding rock chamber 5. When the pressure in the rock chamber has fallen below the condensation pressure, the in-situ evaporation begins there too, as a function of the temperature in each case and the pressure which is established. The evaporation front 22 is drawn in a circular shape in FIG. 6 and in reality represents a three-dimensional surface, the precise form of which is dependent on many kinds of rock physics parameters, such as permeability, porosity, thermal conductivity, density, etc., as should be familiar to the person skilled in the art. Since the steam can escape upward out of the production pipe, a sufficient pressure drop is still available even after a certain time as a motor for the in-situ evaporation. This gives rise in the rock chamber 5 to a vapor region 23, where the vapor phase predominates, and a thermal water area 25, where hot water in the liquid phase predominates. The evaporation front line 22, in FIG. 6, separates the two areas from each other.

The steam can get into the production pipe via the perforation holes in the protective body 9, without any significant loss of pressure. After a sufficiently long production time a quasi-steady-state condition is established, which is dependent on the above-mentioned rock parameters and on the water content of the rock chamber 5.

As concrete examples to illustrate the progressive in-situ evaporation, let us give some pressure values below which liquid water of the stated temperature evaporates in situ: water of 200 degrees Celsius at less than 15.2 bar, corresponding to 39.5 bar at 250 degrees Celsius, 85 bar at 300 degrees Celsius and 165 bar at 350 degrees Celsius. At a pressure lower than 15 bar and a temperature of 200 degrees Celsius the water remains in the liquid phase.

In passing it should also be mentioned that fissuring can also occur, in addition to in-situ evaporation, if the pressure gradient exceeds a value of approximately 40 kilopascals per meter. This phenomenon is largely independent of temperature and is applicable as a rule of thumb to many kinds of rock. The above-mentioned evaporation pressure or condensation pressure, as was shown above, is strongly dependent on temperature. The higher the temperature of the geothermal system, the higher is the evaporation pressure. It follows from this that in hot systems the evaporation front progresses further into the rock 5, and the steam production as a result of the higher vapor density at higher pressures is greater than in corresponding systems with the reverse specification.

In an advantageous way the present invention results in an evaporation of formation waters which from the energy point of view is considerably more favorable than the recovery of an equally large mass of hot water (thermal water or thermal brine) to the ground surface, since the superheated steam flows practically spontaneously and carries a far higher internal energy within itself, relative to the same mass, than hot water.

A further, independent advantage is that it is low-permeability rocks in particular which can be exploited, because the ability of water vapor to flow through such rocks is better by orders of magnitude than that of water in the liquid phase. Pores and fissures which are impassable because of the strong adhesive effect of liquid water are as a general rule readily permeable to steam.

Figure 7:
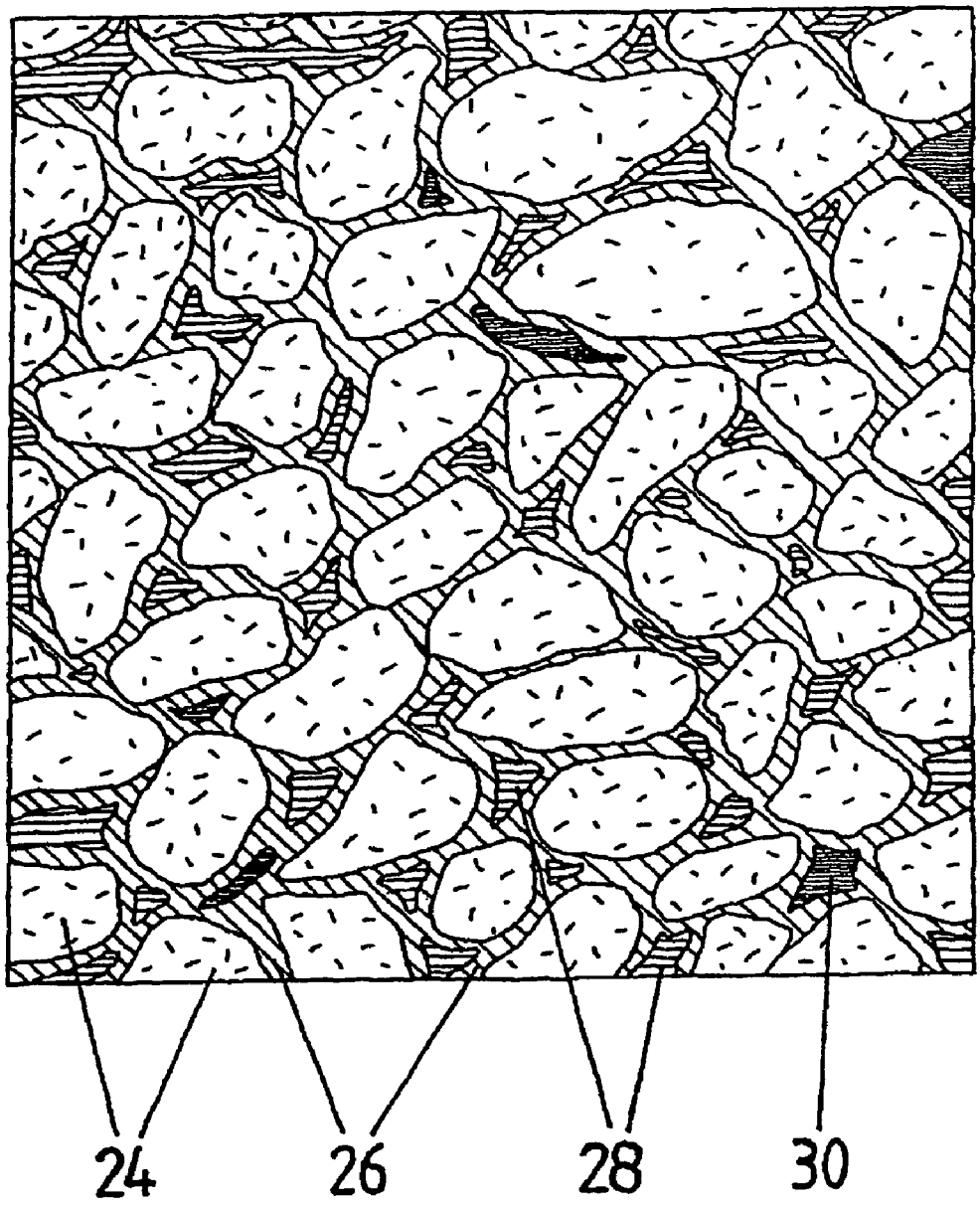
FIG. 7 represents a schematic cross-section through a sandstone.

The advantageous effect of in-situ evaporation is described below, with reference to FIG. 7 and FIG. 8, in connection with the economic utilization of superheated steam in its production. FIG. 7 shows an exemplary schematic cross-section through a sandstone with a total porosity of 10% and an effective porosity of 1%, at a scale of about 50:1. Sandstone consists of quartz grains 24, rounded to a greater or lesser degree, which are often relatively well sorted because they were deposited under fluviatile conditions. The primary porosity was about 30%. Later diagenetic processes have reduced the porosity to 10% and the permeability to about 50 millidarcy (mD). The values given here are typical values for the bunter sandstone deposited at great depth in the Upper Rhine plain. They are solely of an exemplary nature. The permeabilities for in-situ evaporation should preferably be even lower.

The following should be noted for purposes of clarification: effective porosity is that proportion of the pore volume of the total rock which is interlinked. Liquids and gases can flow through the effective porosity. An example of an effective pore space, with reference sign 30, is marked with close hatching. The "non-effective" porosity is that proportion, 28, of the non-interlinked pores in the total volume whose contents can evaporate, according to the invention, through secondary effects when the low pressure is introduced. The pore cement 26 is fine-grained material with a permeability of nearly 0 and therefore constitutes an obstacle to permeability.

Figure 8:
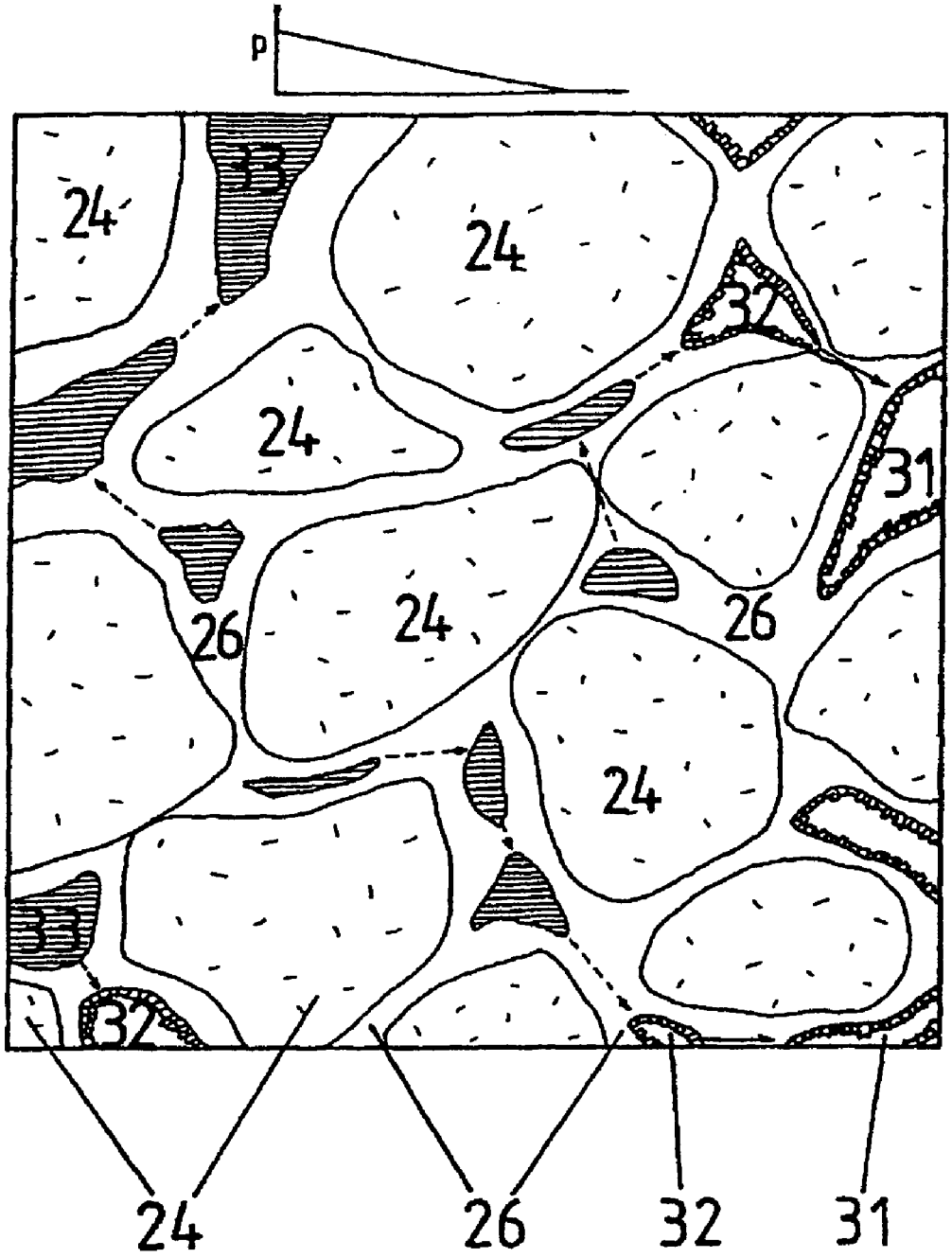
FIG. 8 is a section enlargement of FIG. 7, to represent the effects to be expected after the start of in-situ evaporation according to the present invention.

With reference to FIG. 8 the processes changing porosity and permeability, which are to be expected after the start of in-situ evaporation, and which are triggered off by measures according to the present invention, are outlined below: reference sign 31 represents pores which form part of the effective porosity, as defined above. The fluid content of the pores has been evaporated after a sufficiently long time after the opening of the seal 8. The previously dissolved solids content has crystallized out in the pore volume. Reference sign 32 denotes pores which were opened through secondary effects of in-situ evaporation and now form part of the effective porosity. A sufficient decrease in pressure then leads to the evaporation of the liquid contained in these pores. This vapor escapes through the previously present pervious parts and sometimes also through fine fissures which have formed through the sudden reduction in pressure according to the invention. Precipitated substances which were previously in solution are then also found in such pores.

Reference sign 33 denotes pores which even some time after opening of the seal are still filled with liquid and sealed off from the remaining pore space. These pores can still become part of the effective porosity, at a later point in time, if there is a sufficiently long and sufficiently big decrease in pressure and/or temperature.

The solid arrows are intended to represent existing flow paths for water and water vapor, whereas the dashed arrows represent new flow paths, mainly for water vapor, which are available at a later point in time, after fine fissures have formed as a result of the invention. The direction of the arrows is obtained from the pressure drop, which is shown in outline above. The direction, on the right radially toward the borehole and on the left radially away from the borehole to the rock chamber, is also obtained from this.

The aforesaid secondary effects and their causes are briefly outlined below:

There is an increase in the permeability through the at least partial linking of the pore space previously closed off to the effective porosity, caused by rock stresses as a result of the temperature changes, taking effect in a small space, which were triggered according to the invention by the in-situ evaporation.

Furthermore, at least part of the pore space closed off, which is at higher pressure, is "blasted free" after the pressure in the neighboring effective porosity has fallen below a critical value.

Fissuring occurs solely through the marked pressure drop in the direction of the borehole.

An additional fissure space, i.e. additional porosity, is created by rock contraction, as the evaporation process removes energy from the system and leads to cooling.

Figure 9:
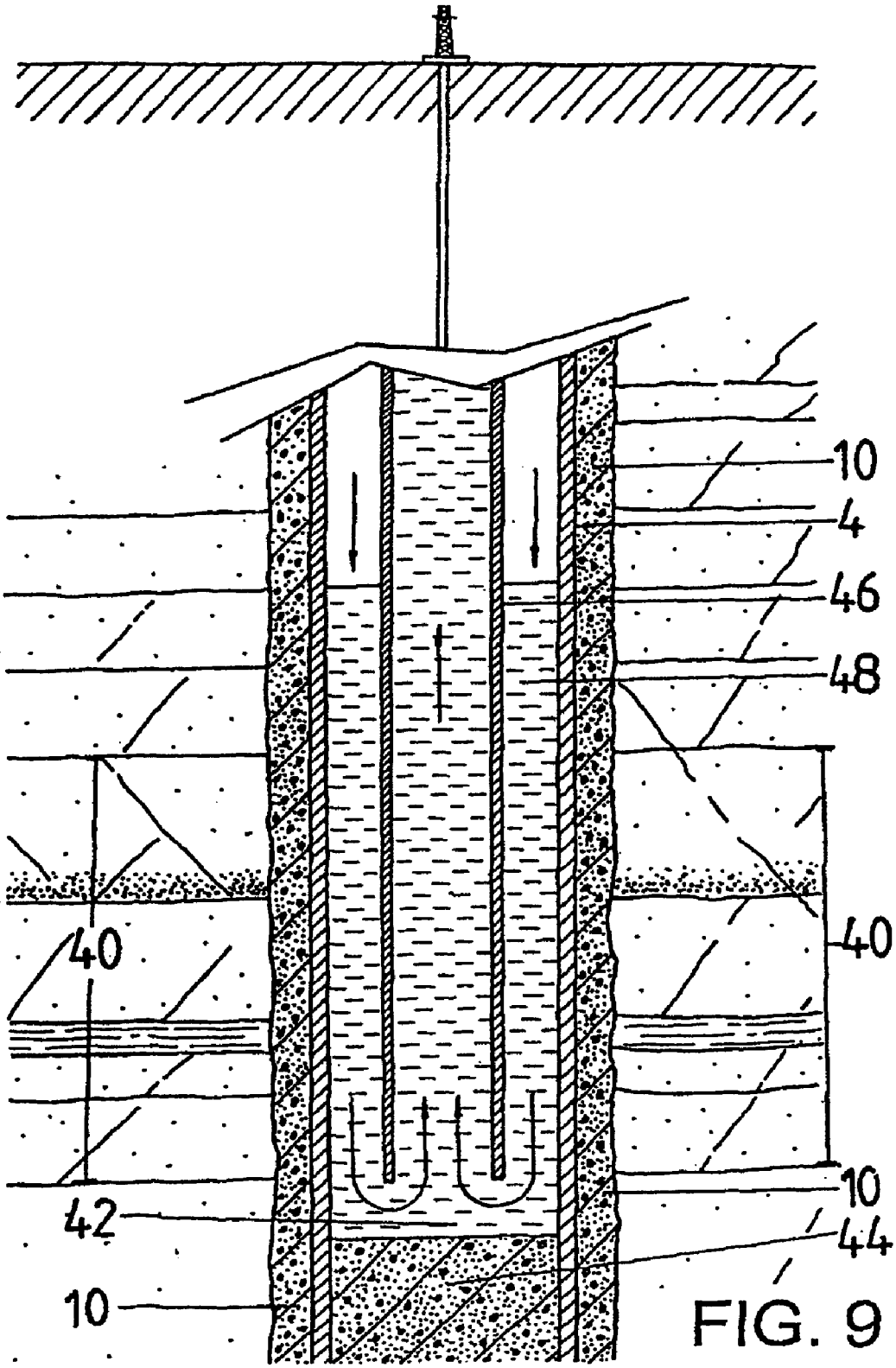
FIG. 9 is an outline drawing for a further embodiment of the method according to the invention, in which the casing is directly used for steam production.

A further, alternative procedure of the inventive method, in which the casing is used only for steam production, is described below with reference to FIG. 9 and simultaneous reference to FIG. 2. An exemplary borehole configuration, in which the target horizon 40 to be worked lies somewhat above the lower end of the casing, was chosen in this embodiment. As in FIG. 2, the casing 4 has a corresponding casing cementing 10 in the area of the target horizon. Depending on the geological conditions there is a greater or lesser amount of water in the interior of the casing 4.

The deepest point of the borehole, i.e. the bottom of the borehole, is now cemented up in a pressure-resistant way. This cementing is indicated with reference sign 44. If drilling mud is still present in the casing, this is then replaced by water.

The water in the casing is then completely removed. This can for example be done expediently by lowering a central pipe string as a pumping pipe 46 into the casing to a sufficient depth, with the annular space 48 to the casing 4 being used to impact the water column with a sufficiently high overpressure to force the water in the casing upward again through the inside of the pumping pipe 46. The water then runs out of the pumping pipe on top. For this it is essential that the pumping pipe 46 is at a sufficient distance from the cementing 44, so that the water can flow into the inside of the pumping pipe, following the pressure artificially applied from above. If the pressure forces are sufficiently great, the water can be removed almost completely from the casing. The application of the pressure can be effected expediently by means of compressed air. The annular space 48 is sealed at the ground surface with a high-strength lid, in order that it can withstand the pressure which is injected into the annular space. This can amount to 500 bar at a depth of 5,000 m. Depending on the depth of the borehole, a corresponding compressive pressure of several 100 bar in some cases must be applied in order to force the entire water column of the annular space upward through the pumping pipe 46. As soon as the compressed air has forced the water level of the annular space down to the pipe shoe of the pumping pipe 46, it enters the pumping pipe 46, which is still full of water, and raises the liquid content of this pipe upward until it escapes at the ground surface. There is no significant mixing of liquid and gaseous phase in the pumping pipe, especially if the internal diameter of the pumping pipe is sufficiently small, as compressed air with several 100 bar already takes on liquid-like properties.

Even if there is limited mixing, the liquid is entrained to the ground surface in accordance with the principle of the airlift method. A residual amount of water left in the region above the cementing 44 will quickly evaporate, especially if the rock chamber 5 has a high temperature. The borehole is thus finally empty and the pumping pipe 46 can be removed again.

In order now to be able to begin a steam production run, the casing 4 is perforated with the aid of conventional, so-called "perforation guns", so that the atmospheric pressure in the casing 4 can come into contact with the surrounding rock chamber 5, takes effect there and can initiate the in-situ evaporation according to the invention.

Perforation guns secured on wire ropes are preferably used in this operation, as they can be removed relatively quickly out of the borehole after the start of steam production. The perforation lengths should be decided separately from case to case and adapted to the local geological conditions. A greater length should, however, be perforated at one go rather than too short a length, as the correct steam rate can be precisely adjusted by choking the steam flow which begins, but the reverse is not possible. All the electrical components of the perforation guns can be made temperature-adapted. Cable insulations, in particular, can be produced for this purpose from electrically insulating material that is resistant to high temperature. Switches can be redundantly actuated both electrically and also mechanically and electromechanically (relay switches).

In an advantageous way, relatively long pipe sections should be perforated, in order to guarantee adequate steam production. Even if the use of the perforation guns should lead to the formation of a permeability barrier for liquids, as is known in the prior art, because the rock behind the casing is locally fragmented and partially pulverized, this barrier does not form an obstacle for gas in the form of water vapor. A very large cross-section can thus be used in an advantageous way for the transport of the superheated steam upward, which has a favorable effect in particular in geological formations with less extremely high temperatures, as long as the other conditions and rock physics parameters, as mentioned above, are favorable.

For this purpose consideration should be given in particular to regions which have a relatively high geothermal gradient even in sedimentary sequences, and which are very common outside the actual volcanic regions. Such situations are for example associated with regions with a thinned crust, e.g. Hungary, mantle domes in nonvolcanic rift structures, e.g. Rhine plain, and other macrostructural conditions. The temperatures in said regions can typically reach only 180 to 220 degrees Celsius at depths of about 3500 to 4500 meters.

Since in geothermal electricity generation the steam mass used correlates approximately with the electrical power (1 kilogram per second of steam corresponds to about 0.5 MW of electrical power), it is absolutely essential to plan the steam production in such a way that a modern, economically operating steam turbogenerator can be used for the operation. The aforesaid geological systems with the relatively low temperatures can therefore only supply steam with relatively low temperatures. Since the steam density as a function of temperature is also relatively low in these cases, the production pipes for the steam should have as big a diameter as possible, in order to be able to convey the required mass of steam per unit of time to the earth surface. For this reason such variants of the methods according to the invention as directly use the casing itself, with a diameter of 9⅝ inches or more for example, are advantageously used in such situations.

If necessary, 'perforation guns' might also be cooled in order to obtain the required temperature stability.

Figure 10:
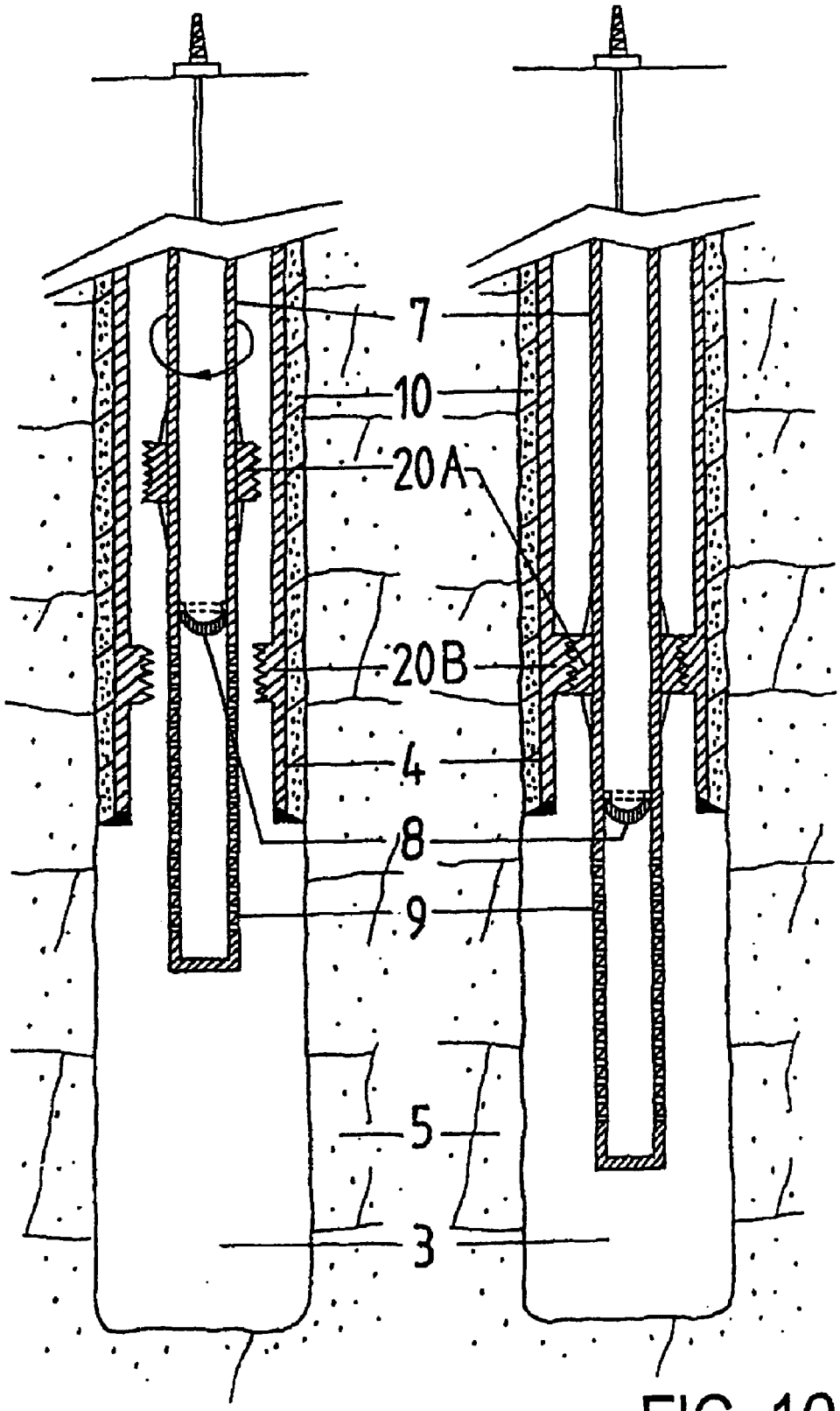
FIG. 10 is an outline drawing to illustrate an alternative internal seal to the internal seal shown in the embodiment in FIG. 3, and FIGS. 11–13 are outline drawings to illustrate a specially preferred internal seal, which can be reversibly actuated, through a "valve pipe" as the lower pipe end fitting of the production pipe string, in three different positions.

With reference to FIG. 10 an alternative internal seal, which can be used instead of or, if necessary, in combination with the annular packer 6 from FIGS. 3 and 4, is described below.

As can be seen from FIG. 10, here too the production pipe 7 exhibits a sufficiently perforated protective body 9, which protects the internal seal 8 that is also present.

The final section of the production pipe, however, exhibits an external thread 20A, which is provided for engagement with a matching internal thread 20B, which in turn is provided on the end section of the casing 4. The production pipe is lowered as previously described, with the movement being suitably slowed down before the threaded stage is reached. In order that the threaded parts can slide better into each other, provision is advantageously made to bevel the upper edge section of the internal thread on the casing 4 and the lower edge section of the external thread on the production pipe at matching angles. This facilitates the fitting of the production pipe in the appropriate centered form. So as not to let the torque needed for screwing in become too great, the bearing force can be reduced by pressing the production pipe slightly upward as soon as a complete turn of the thread is engaged.

Furthermore, the usual technical measures can be taken in order to reduce sliding friction arising when screwing in. These only need to be adapted to the temperatures, which are often very high in the case under consideration. The thread surfaces can be coated with a teflon or a graphite laminate, for example. When the revolution is completed, the picture shown in FIG. 10 on the right is obtained, and the pressure seal is adequately produced. From here it is possible to link up with the description from FIGS. 3 and 4 et seq.

The construction and mode of operation of a reversibly opened and closed pressure seal for a production pipe 7 of superheated steam, which is used in combination with the screw closure seal 20A, 20B in FIG. 10, in the form of a preferred embodiment, are described below with reference to FIGS. 11 to 13. In an advantageous way it is possible to choose whether the interior of the production pipe 7, the annular space 48, or both are used to convey the geofluid. All statements of dimensions are to be understood solely as examples.

The casing 4, having a bottom 64, is not cemented for about 12 m of length in its lower end section 60, but inserted already with perforations 66 of suitable size in the lateral wall 62 and in the bottom 64. Over the entire length of the perforated casing section the space between the casing and the rock 5 is not cemented to the rock chamber but filled with hot liquid (water or brine) at high pressure.

A sealing pipe section 70, here a titanium pipe of about 2 m length, is screwed in on the inside of the casing 4, about 16–20 m above the bottom of the casing, so as to form a pressure-proof seal. An externally threaded member 74, which is fastened to the titanium pipe on the outside, and which can suitably engage with a threaded fitting welded to the casing, is used for this purpose. It is expedient to screw the parts in place already before the casing is installed. The threaded member 74 therefore contains a sealing surface of adequate size, pointing radially inward, which becomes a seal by virtue of the fact that a further, suitably dimensioned section of pipe can be brought into sealing but sliding contact, with the section of pipe having valve functions, as described below. In this way a pressure seal 2, which separates the lower borehole chamber 3 from the flow chamber 1, is formed together with the valve pipe 68, described below, as a section of pipe.

The perforated casing section 60 also serves as a protection pipe against secondary breakage of parts of the borehole wall, which is to be expected as a result of the sudden removal of pressure when the evaporation process is started, and it thus keeps the lower part of the casing 60 free of rock fragments. That is advantageous for ensuring that the production pipe string, with its lower special pipe made of titanium (=valve pipe), keeps relative freedom of movement in this space.

The valve pipe 68 is screwed to the production pipe string 7 at its upper end and exhibits three solid pipe sections 76, 78, 80 without perforations, arranged below each other, and two perforated pipe sections 82, 84, arranged individually between these. The length of the perforated and of the closed pipe sections is about 3 m in each case, while the (solid pipe) section 76 is about 5 m long. The section lengths can be varied according to requirements. The lower end 86 of the valve pipe 68 is closed and tapered.

An above-ground suspension device for the production pipe 7 also serves at the same time for precisely controllable vertical movement of the production pipe, so that certain predetermined sections of the valve pipe 68 always lie in the area of the sealing surface of the pressure seal 7. The steam flow can thus be controlled as follows:

| | |
|---|---|
| valve pipe section 80: | position "closed", |
| valve pipe section 78: | position "steam flow in the annular chamber and in the production pipe", |
| valve pipe section 76: | position "steam flow only in the production pipe". |

With suitable dimensioning of the parts forming the seal and entry surfaces, and adjustment of partial overlap of the sections, it is also possible to control the proportions of the flows through the production pipe and annular chamber, respectively, and choke the total flow.

The lower end of the inevitably liquid-filled valve pipe is inserted with its lowest solid pipe section 80 into the area of the pressure barrier after the pressure seal formed by the threaded seal of the parts 72 and 74 is fitted. The upper end of the screw-closure pressure seal is funnel-shaped and thus serves to position the valve pipe more easily.

In this first position there is a complete and pressure-tight separation of the lower uncemented borehole region 3 from the upper borehole region which serves as the flow chamber 1. According to this embodiment this flow chamber consists of the annular chamber and the interior of the production pipe 7, which can optionally be used only singly or both together. This is effected by the control through the valve pipe 68, as is described below.

The titanium pipe 70 and the valve pipe 68 are not only made with absolute precision, ensuring that they fit, but are also sealed with a thin layer of a material which is resistant to high temperature and cannot be chemically attacked. This layer also serves as a lubricant. It is applied either to the inside of the screwed titanium pipe or to the outside of the production pipe, or possibly to both. Application of the layer to the valve pipe might be more advantageous, as the valve pipe can be removed and then given a new sealing and lubricant layer above ground. The materials known in the prior art which are resistant to high temperature and high pressure come into consideration for this purpose. Examples are: graphite, or graphite compounds, molybdenum sulfide, carbon monofluoride, polytetrafluoroethylene. Furthermore, the piston ring systems known in the prior art can be used instead of or in combination with the lubricant/sealing layer. In these a continuous slot provides a certain flexibility and an increased seal, even if there is thermal expansion or shrinkage of the material. More than one ring can be arranged preferably behind each other on the pipe section 70, with slots staggered in relation to each other.

Before the in-situ evaporation is started, the liquid—water or brine—is removed from the annular chamber and the production pipe (above the pressure barrier), this being done by introducing compressed air into the annular chamber, which forces the liquid through the production pipe to the ground surface. This has already been described above. For this the valve pipe 68 is in the completely sealing position 1. A certain level of residual liquid can be tolerated, but at the high temperatures in this part of the borehole it should also very quickly evaporate spontaneously.

After drainage of the production pipe 7 the in-situ evaporation in the lower borehole chamber is started as follows:

The valve pipe 68 is lowered by control above ground until the middle solid pipe-valve pipe section 78 is positioned at the level of the pressure seal. The perforated valve pipe section 84 is thus already in the lower borehole chamber, and the perforated valve pipe section 82 is in the area of the flow chamber. In addition, an opening to the annular chamber 14 is formed. The atmospheric pressure immediately takes effect in the lower borehole chamber. The steam-hot water mixture produced at the start of the evaporation can now escape upward, with not only the annular space but also the production pipe itself being available as flow paths, provided that the latter is not closed at the upper end.

An initially closed production pipe might be advantageous at the start of the evaporation, because the mineral precipitates possibly arising from the hot water are then deposited predominantly in the annular space, and the cross-section of the production pipe remains largely free of such deposits.

The utilization of the entire cross-sectional area of the annular space and the cross-sectional area of the production pipe makes it possible in an advantageous way to produce a greater mass of steam per unit of time, and reduces the loss of pressure in the delivery path, relative to delivery only through the production pipe 7 alone.

As soon as the evaporation front arising in the deepest point of the borehole enters the rock 5 and has already covered a certain distance there, i.e. only pure steam production still needs to be taken into account, the production pipe 7 can be lowered until the solid pipe-valve pipe section 76 reaches the level of the pressure seal 70. Steam is then flowing only through the production pipe to the earth's surface.

After the start of the evaporation the production pipe is in principle dispensable. It can therefore be pulled out and re-inserted later if necessary, in order for example to shut off the steam flow preferably in the deepest point of the borehole. It is then also possible to apply new sealing coats and remove accretions in the pipe.

If the steam flow subsequently abates, the sealing pipe section 70 screwed into the casing 4 can advantageously be completely removed, in order to increase the cross-sectional area at this bottleneck and thus increase the steam production again. This also applies to cases where after the end of steam production the well as a whole is to be used only for the production of thermal water.

As the in-situ evaporation here forms the actual subject matter of the description, the above-ground installations are not described in detail. They must have suitable devices which take the steam from the annular space and/or from the central production pipe and feed it to the intended technical use.

As should be clear from the preceding description, the present invention is based on the introduction of very low pressure into the lower borehole chamber and thus into the adjoining rock strata 5. The resultant evaporation of geofluids and/or fissuring in the rock chamber is then turned to economic use. Certain physical parameters are necessary in the area of application of the evaporation and use of the superheated steam above ground. The water and rock temperatures should thus be sufficiently high, the introduction of the low atmospheric pressure should take place very quickly, and the permeability of the rock to water and/or aqueous solutions should, in the absence of other technical measures, be so low that the evaporation rate is higher than the inflow of said fluids in the liquid phase into the borehole.

These physical parameters must be carefully checked before the method according to the invention is applied in one of its embodiments for the utilization of superheated steam or for the improved recovery of crude oil or natural gas through fissuring, or for the other areas of application mentioned above. After the steam flow has been started up by the inventive measures, it is for example possible, by means of a flow choke in the production pipe, to influence the current delivery rate and thus also the pressure conditions present in the production pipe. The initial conceptual determination of the pipe diameters is another important parameter. The distance to which the evaporation front extends into the rock 5 is highly dependent on the above-mentioned secondary effects, which are to be expected but can be calculated only with difficulty in each individual case. These secondary effects can cause an increase in the permeability of the rock, so that the pressure gradient between the borehole and the evaporation front flattens off and the critical condensation pressure (evaporation pressure) can move further into the rock chamber 5.

In a case in which the evaporation process initiated according to the invention delivers greater amounts of superheated steam at the start of the evaporation, but afterward the following liquid phase arrives in an ever greater quantity as a result of the increased rock permeability due to the evaporation, the liquid phase can become dominant over the vapor phase and lead to a considerable reduction of the vapor phase in the production pipe. In such a case the increased rock permeability so caused can lead, even after the end of the steam production, to the economically attractive production of thermal water and/or thermal brine, which might then be utilized by the hydrogeothermal methods known in the prior art. Such a scenario can arise in particular at reservoir temperatures of below 200 degrees Celsius (473 Kelvin).

The pressure drop induced by the present invention in the rock chamber 5 can in principle also lead to an increased oil yield in low-yielding oilfields with oil-bearing rocks of low permeability, by virtue of the fact that the marked pressure drop in the direction of the borehole increases the flow rate of the oil, produces additional fissures in the rock, and converts the aqueous phase frequently contained in the oil-bearing rock into steam, which once again is beneficial for the flow behavior of the oil.

It should also be noted that the method according to the invention should be combined with proven partial measures known in the prior art in order to solve particular individual problems: in cases for example where solids such as pulverized rock and small rock fragments are also entrained by the steam flow in the initial phase of steam production, the proven so-called deflectors known from natural gas production can be used to prevent such solids from not getting into the steam turbine.

In the same way the method according to the invention can also be modified in one or another of its embodiments, in order to test the economic viability of a planned use of a well, before costly investments are made in above-ground facilities, such as the installation of turbogenerators, power transmission lines or district heating pipelines. The invention therefore also encompasses such modifications of the method as entail re-introduction of atmospheric pressure into a well that has already been stimulated previously according to the invention.

Furthermore, the method according to the invention can also be used not to recover the superheated steam directly but, after passing it only through certain parts of the flow chamber 1, to bring the steam into other downhole regions which are near enough, in order better to exploit another geoproductive resource there, if one is present there. The melting-out of sulfur or the heating of heavy oil, in order to facilitate the recovery thereof, may be mentioned as examples.

In order to initiate evaporation it is also possible to produce a first rapid removal of pressure in the lower borehole region, with the aim of falling below the (temperature-dependent) condensation pressure, after which the subsequent reduction of pressure takes place gradually or in smaller steps. This can be achieved through the position of the valve pipe 68, if necessary in combination with other above-ground equipment. Such a procedure might be advantageous in particular in very hot volcanic systems with condensation pressures of 85 bar or more, since the mass of the solid rock which breaks away from the lower borehole region and is partially discharged to the earth's surface might in this way be reduced.

Other sealing principles can also be applied. A fusible seal, which opens when exposed to heat, or an acid-soluble seal may be mentioned as examples. The fusible seal might consist of an alloy, precisely adapted to the temperature in the lower borehole chamber, which can then be melted by applying just a relatively small additional amount of heat, perhaps with the aid of a "thermite charge" known from the prior art. "Tailored" alloys are known in the prior art. The following come into consideration, among others: tin, lead, antimony or zinc, etc. The above-mentioned falling body might also be of such composition that it melts after destruction of the seal, if because of its size or shape for example it is not entrained upward with the steam flow.

Although the present invention has been described above by means of a preferred embodiment, it is not limited thereto but can be modified in many ways.

Instead of the valve pipe 68 and the sealing pipe section 70, another, reversible seal might also be inserted into the casing 4, in which the production pipe, in its entire lower section below the pressure seal 70, has perforation openings which match openings created in a downward protruding, otherwise closed pipe extension of the pressure seal 70. The pipe extension is for example 12 m long, extends into the lower borehole chamber and is connected in a twistproof way to the threaded lug of the pressure seal. The openings can then be aligned with each other by turning the production pipe about its own axis, so that one position is defined as "open". The pipe can correspondingly be turned into the "closed" position, or a partial overlap of the openings can be controlled, in order to choke the flow. In the rotary control due allowance must be made for the torsional elasticity of the production pipe string. Feedback on whether the seal really is completely closed can be obtained via a pressure measurement in the production pipe string.

Figure 11:
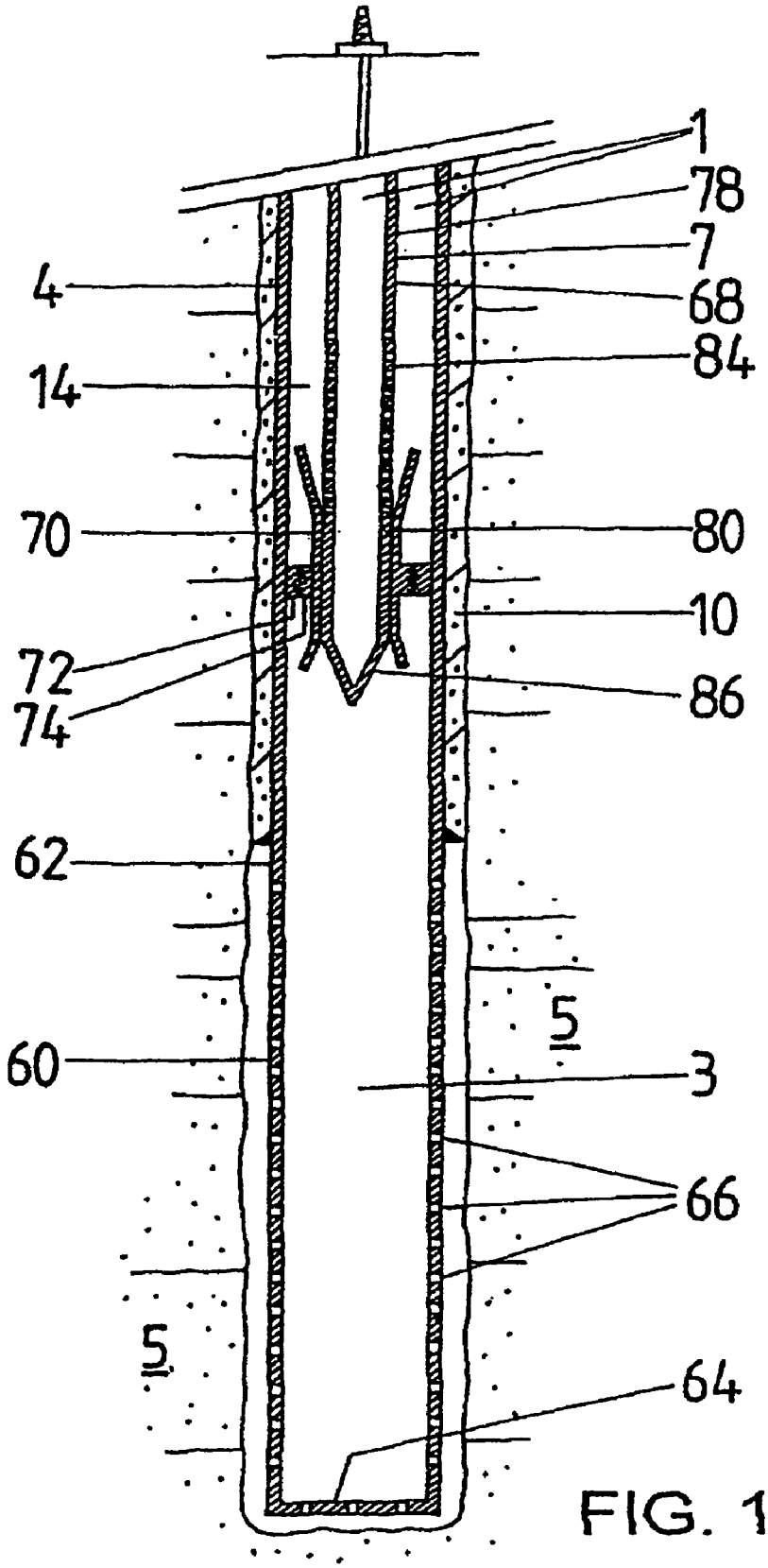
Figure 12:
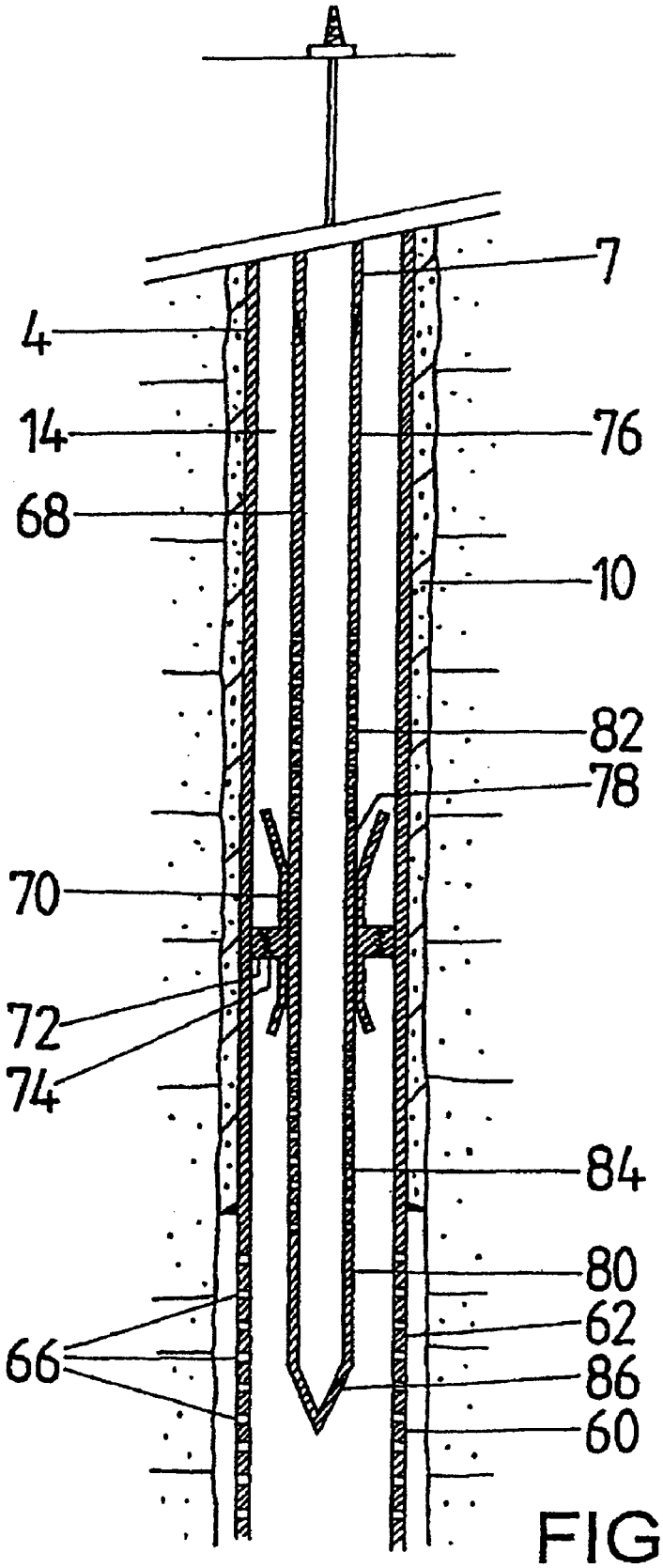
Figure 13:
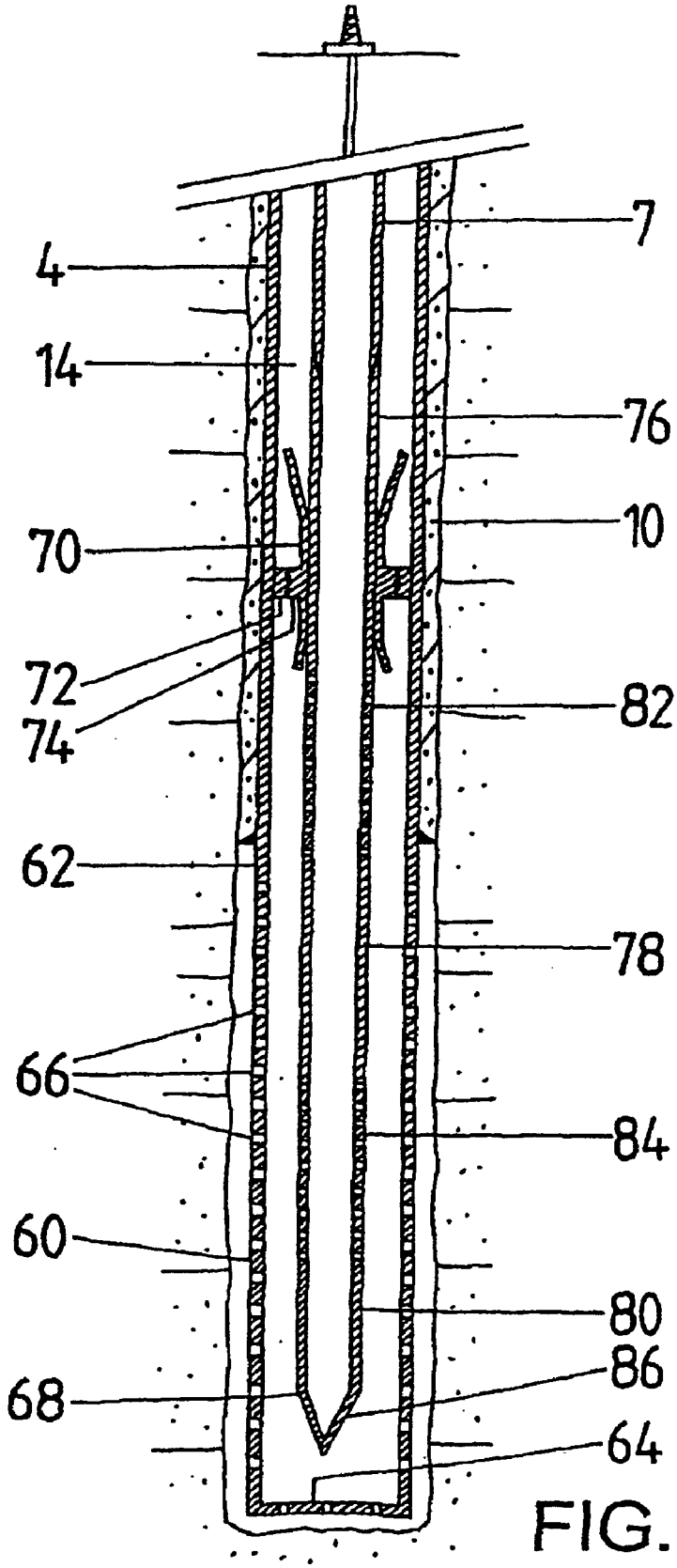

The reversible seal type, containing the valve pipe from FIGS. 11 to 13, offers several advantages over the last-mentioned rotary variant, however. The lifting and lowering of the inner perforated pipe string can be carried out with greater precision and faster than the rotation of the lower perforated inner pipe, connected to the production pipe, in order to achieve congruent positions of the perforations in the inner and outer pipe. The lifting takes place by mechanical force, and the lowering can be carried out essentially through the weight of the production pipe string. In addition there is the possibility of also channeling the steam flow in a controlled way into the annular space 14.

Finally, the characteristic elements of the dependent claims can in essence be combined with each other freely, and not in the sequence present in the claims, insofar as they are independent of each other. In particular the internal seal can also be provided in addition to another seal, and different technical devices can be provided or executed in multiple redundant form.

If it is suitably adapted, the method according to the invention can also be applied to multilateral wells.

The invention claimed is:

1. A method for the exploitation of desirable geoproductive resources from boreholes having therein a casing and a pressure barrier which provides a pressure-tight separation of an external chamber around the casing from a lower borehole chamber, the method comprising:

a) fitting a pressure seal within the casing to provide pressure separation between the lower borehole chamber and a flow chamber above the seal within the casing;

b) introducing a working pressure at least into parts of the flow chamber; and c) abruptly disabling the pressure seal to introduce the working pressure into the lower borehole chamber, the working pressure being sufficiently lower than the pressure previously present in the lower borehole chamber due to the prevailing rock strata pressure that the resulting difference in pressure induces physical and/or chemical processes in the lower borehole chamber and/or in the rock strata surrounding the latter which render the desirable geoproductive resources exploitable and further comprising the steps of:

d) fitting an internal seal into the lower end of a production pipe adapted to be inserted in the casing;

e) fitting an external pressure seal in the form of a screwable sealing device around the production pipe, the external pressure seal being so located and configured that, when the production pipe is inserted into the casing, the seal provides pressure-tight separation of the external chamber around the production pipe from the lower borehole chamber;

f) introducing the production pipe, with the internal and external seals pre-installed, into the borehole chamber;

g) activating the external pressure seal;

h) opening the internal seal of the production pipe; and i) using the interior of the production pipe as the flow chamber wherein the screwable sealing device includes a threaded member connected to the casing, and a matching threaded member having a sealing surface pointing radially inward, which is adapted to make sealing contact with a further pipe section; and wherein the further pipe section is a valve pipe connected to the production pipe, wherein the valve pipe has a plurality of openings of predetermined size and shape at predetermined places, and which can reversibly be brought by corresponding control movements into different positions, which distinguish at least "open" and "closed" and connect the flow chamber and the lower borehole chamber or separate them from each other in a pressure-tight way.

2. The method as claimed in claim 1, further comprising removing water or other materials found in the flow chamber from a major part of the flow chamber before introducing the working pressure.

3. The method as claimed in claim 1, further comprising producing the working pressure by introducing essentially atmospheric pressure into the lower borehole chamber.

4. The method as claimed in claim 1, wherein the internal seal consists of a material which contains ceramic components.

5. The method as claimed in claim 1, wherein the internal seal has a downward-convex shape.

6. The method as claimed in claim 1, wherein the production pipe with the internal seal is brought to a target depth while protected by a protective body.

7. The method as claimed in claim 1, further comprising the step of placing expandable annular packers that are resistant to high pressure and resistant to high temperature between the production pipe and the casing to provide the external pressure seal, for application in the high pressure and high temperature range for in-situ evaporation of liquid phase geoproductive resources.

8. The method as claimed in claim 1, wherein the screwable sealing device contains a threaded member, connected to the casing, and a matching inner threaded member, which is securely connected to a section of the production pipe.

9. The method as claimed in claim 1, wherein the screwable sealing device includes a threaded member, connected to the casing, and a matching threaded member having a sealing surface pointing radially inward, which is adapted to make sealing contact with a further pipe section.

10. The method as claimed in claim 1, further comprising opening the internal seal by destroying the seal by a falling body which falls through the flow chamber.

11. The method for the recovery of superheated steam from a reservoir which has a geoproductive potential that was exploited by the method as claimed in claim 1, comprising the further steps of:

a) transporting steam through the flow chamber of the borehole, and b) using the energy contained in the steam for the production of a desired secondary energy.

12. A method for the recovery of superheated steam from a reservoir as claimed in claim 11, wherein the desired secondary energy is electricity or process heat.

13. A method for the recovery of geofluids containing hydrocarbons from a reservoir which has a geoproductive potential that was exploited by the method as claimed in claim 1, further comprising the step of:

transporting of the recovered geofluid through the flow chamber of the borehole.

14. The method as claimed in claim 1, wherein the pressure seal is disabled destructively.

15. The method as claimed in claim 1, wherein the pressure seal is disabled by opening the seal in a reversible manner.

16. The method as claimed in claim 1, wherein the external pressure seal is so located and configured that the seal is provided in the annular space between the production pipe and the casing.

17. The method as claimed in claim 1, further comprising producing the working pressure by introducing essentially atmospheric pressure into the lower borehole chamber.

18. The method as claimed in claim 1, further comprising, suddenly opening the pressure seal to introduce the working pressure.

19. The method as claimed in claim 1, wherein the internal seal has a downward-convex shape.

20. The method as claimed in claim 1, further comprising the step of installing a threaded member, connected to the casing, and a matching threaded member, which has a sealing surface pointing radially inward, which is set up to make sealing contact with a further pipe section.

21. The method as claimed in claim 1, wherein the openings when brought into the open position determine in their totality a total passage cross-section, and the cross-section may be controlled by preselected vertical movement of the valve pipe.

22. The method as claimed in claim 21, wherein the valve pipe has a plurality of pipe sections, which alternately have openings or do not have openings and the sections are dimensioned such that they can be brought into sealing contact with a sealing pipe section as a part of the screwable sealing device.

23. A method for the recovery of superheated steam from reservoirs the geoproductive potential of which was exploited by the method as claimed in claim 21, comprising the steps of:

a) transporting steam through the flow chamber of the borehole, b) using the energy contained in the steam for the production of a desired secondary energy.

24. A method for the recovery of geofluids containing hydrocarbons, from reservoirs the geoproductive potential of which was exploited by the method as claimed in claim 21, comprising the step of:

transporting of the geofluid through the flow chamber of the borehole.

25. The method as claimed in claim 1, wherein the external pressure seal are provided by expandable annular packers which are resistant to high temperatures and high pressures.

26. A method for the exploitation of desirable geoproductive resources from boreholes having therein a casing and a pressure barrier which provides a pressure-tight separation of an external chamber around the casing from a lower borehole chamber, the method comprising:

a) fitting a pressure seal within the casing to provide pressure separation between the lower borehole chamber and a flow chamber above the seal within the casing;

b) introducing a working pressure at least into parts of the flow chamber; and c) abruptly disabling the pressure seal to introduce the working pressure into the lower borehole chamber, the working pressure being sufficiently lower than the pressure previously present in the lower borehole chamber due to the prevailing rock strata pressure that the resulting difference in pressure induces physical and/or chemical processes in the lower borehole chamber and/or in the rock strata surrounding the latter, which render the desirable geoproductive resources exploitable and further comprising the steps of:

d) fitting an internal seal into the lower end of a production pipe adapted to be inserted in the casing;

e) fitting an external pressure seal in the form of a screwable sealing device around the production pipe, the external pressure seal being so located and configured that, when the production pipe is inserted into the casing, the seal provides pressure-tight separation of the external chamber around the production pipe from the lower borehole chamber;

f) introducing the production pipe, with the internal and external seals pre-installed, into the borehole chamber;

g) activating the external pressure seal;

h) opening the internal seal of the production pipe; and i) using the interior of the production pipe as the flow chamber; and further comprising introducing a filling pack, permeable to a vapor or gaseous phase, into the lower borehole chamber.

27. A method for the exploitation of desirable geoproductive resources from boreholes having therein a casing and a pressure barrier which provides a pressure-tight separation of an external chamber around the casing from a lower borehole chamber, the method comprising:

a) fitting a pressure seal within the casing to provide pressure separation between the lower borehole chamber and a flow chamber above the seal within the casing;

b) introducing a working pressure at least into parts of the flow chamber;

c) abruptly disabling the pressure seal to introduce the working pressure into the lower borehole chamber, the working pressure being sufficiently lower than the pressure previously present in the lower borehole chamber due to the prevailing rock strata pressure that the resulting difference in pressure induces physical and/or chemical processes in the lower borehole chamber and/or in the rock strata surrounding the latter, which render the desirable geoproductive resources exploitable;

d) transporting steam only through parts of the flow chamber of the borehole, and e) introducing the steam into other regions of the rock strata, in order to render geoproductive resources present there exploitable or better exploitable.

28. The method as claimed in claim 27, wherein the difference in pressure is sufficient to induce a physical process which increases the permeability of the rock strata surrounding the borehole.

* * * * *